US012685548B2

(12) United States Patent
Shrivastava et al.

(10) Patent No.: US 12,685,548 B2
(45) **Date of Patent: *Jul. 21, 2026**

(54) TORQUEABLE DEVICES AND METHODS FOR REMOVING AN EMBOLUS

(71) Applicant: INNOVA VASCULAR, INC., Irvine, CA (US)

(72) Inventors: Sanjay Shrivastava, Irvine, CA (US); Gopan Patel, Orange, CA (US)

(73) Assignee: INNOVA VASCULAR, INC., Irvine, CA (US)

( * ) Notice: Subject to any disclaimer, the term of this patent is extended or adjusted under 35 U.S.C. 154(b) by 596 days.

This patent is subject to a terminal disclaimer.

(21) Appl. No.: 18/145,691

(22) Filed: Dec. 22, 2022

(65) Prior Publication Data

US 2023/0131648 A1 Apr. 27, 2023

Related U.S. Application Data

(63) Continuation-in-part of application No. 17/691,914, filed on Mar. 10, 2022, now Pat. No. 12,285,182, (Continued)

(51) Int. Cl.
*A61B 17/221* (2006.01)
*A61B 17/22* (2006.01)

(52) U.S. Cl.
CPC .. *A61B 17/221* (2013.01); *A61B 2017/22038* (2013.01); *A61B 2017/2215* (2013.01)

(58) Field of Classification Search
CPC ..... A61B 17/221; A61B 2017/00991; A61B 2017/22038; A61B 2017/2212;
(Continued)

(56) References Cited

U.S. PATENT DOCUMENTS 4,880,408 A 11/1989 Cumes et al.
5,246,011 A 9/1993 Caillouette
(Continued)

FOREIGN PATENT DOCUMENTS

AU 2021257925 A1 11/2021
AU 2021236459 B2 2/2024
(Continued)

OTHER PUBLICATIONS

IPcard Cardiac Care, "Export Advance-A Thrombus Aspiration Cather", Online Available at: https://www.youtube.com/watch?v=ymp8uNtFfM0, Retrieved on Nov. 21, 2024, 2 pages.
(Continued)

*Primary Examiner* — Mohamed G Gabr
(74) *Attorney, Agent, or Firm* — NGUYEN TARBET IP LAW

(57) ABSTRACT

A clot retrieval device featuring a capturing basket coupled to a delivery shaft. The capturing basket is deployable to the side of a clot in a blood vessel. The capturing basket is configured to allow for the clot to ingress into the capturing basket and surround at least a portion of the clot. The capturing basket can be torqued by torquing at the proximal end of the catheter resulting in the rotation of the capturing basket about its longitudinal axis.

15 Claims, 16 Drawing Sheets

Related U.S. Application Data which is a continuation-in-part of application No. 16/597,727, filed on Oct. 9, 2019, now Pat. No. 11,272,945.

(60) Provisional application No. 62/744,107, filed on Oct. 10, 2018.

(58) Field of Classification Search
CPC .... A61B 2017/2215; A61B 2090/0811; A61B 2090/3966
See application file for complete search history.

(56) References Cited

U.S. PATENT DOCUMENTS 5,419,774 A 5/1995 Willard et al.
5,429,616 A 7/1995 Schaffer
5,476,450 A 12/1995 Ruggio
5,938,645 A 8/1999 Gordon
6,454,741 B1 9/2002 Muni et al.
6,481,439 B1 11/2002 Lewis et al.
6,508,782 B1 1/2003 Evans et al.
6,776,770 B1 8/2004 Trerotola
7,479,106 B2 1/2009 Banik et al.
7,686,825 B2 3/2010 Hauser et al.
7,901,426 B2 3/2011 Gilson et al.
7,942,852 B2 5/2011 Mas et al.
7,998,104 B2 8/2011 Chang
8,057,505 B2 11/2011 Neilan et al.
8,157,760 B2 4/2012 Criado et al.
8,252,020 B2 8/2012 Hauser et al.
8,382,817 B2 2/2013 Pappas et al.
8,439,963 B2 5/2013 Dickinson et al.
8,545,514 B2 10/2013 Ferrera
8,574,262 B2 11/2013 Ferrera et al.
8,585,713 B2 11/2013 Ferrera et al.
8,632,584 B2 1/2014 Henkes et al.
8,663,301 B2 3/2014 Riina et al.
8,679,142 B2 3/2014 Slee et al.
8,715,312 B2 5/2014 Burke et al.
8,728,141 B2 5/2014 Riina et al.
8,734,374 B2 5/2014 Aklog et al.
8,777,976 B2 7/2014 Brady et al.
8,784,434 B2 7/2014 Rosenbluth et al.
8,852,205 B2 10/2014 Brady et al.
8,915,950 B2 12/2014 Cam et al.
8,926,680 B2 1/2015 Ferrera et al.
8,926,681 B2 1/2015 Levy et al.
8,940,003 B2 1/2015 Slee et al.
8,945,143 B2 2/2015 Ferrera et al.
8,945,172 B2 2/2015 Ferrera et al.
8,956,386 B2 2/2015 Hauser et al.
8,956,475 B2 2/2015 Riina et al.
8,968,330 B2 3/2015 Rosenbluth et al.
8,968,382 B2 3/2015 Riina et al.
9,055,963 B2 6/2015 Miloslavski et al.
9,089,404 B2 7/2015 Zaver et al.
9,108,018 B2 8/2015 Dickinson et al.
9,114,001 B2 8/2015 Losordo et al.
9,149,609 B2 10/2015 Ansel et al.
9,155,552 B2 10/2015 Ulm, III
9,161,766 B2 10/2015 Slee et al.
9,173,668 B2 11/2015 Ulm, III
9,204,887 B2 12/2015 Cully et al.
9,254,205 B2 2/2016 Wainwright et al.
9,259,237 B2 2/2016 Quick et al.
9,301,769 B2 4/2016 Brady et al.
9,301,831 B2 4/2016 Kusleika et al.
9,314,329 B2 4/2016 Dickinson et al.
9,320,532 B2 4/2016 Ferrera et al.
9,326,792 B2 5/2016 Dickinson et al.
9,351,749 B2 5/2016 Brady et al.
9,351,859 B2 5/2016 Cam et al.
9,387,098 B2 7/2016 Ferrera et al.
9,402,707 B2 8/2016 Brady et al.
9,408,620 B2 8/2016 Rosenbluth et al.
9,433,429 B2 9/2016 Vale et al.
9,439,664 B2 9/2016 Sos
9,445,829 B2 9/2016 Brady et al.
9,463,036 B2 10/2016 Brady et al.
9,468,442 B2 10/2016 Huynh et al.
9,468,739 B2 10/2016 Sutherland et al.
9,486,224 B2 11/2016 Riina et al.
9,486,608 B2 11/2016 Sutherland et al.
9,504,551 B2 11/2016 Shrivastava et al.
9,526,864 B2 12/2016 Quick
9,526,865 B2 12/2016 Quick
9,532,803 B2 1/2017 Dickinson et al.
9,539,022 B2 1/2017 Bowman
9,545,263 B2 1/2017 Lenihan et al.
9,597,171 B2 3/2017 Shrivastava et al.
9,610,180 B2 4/2017 Cam et al.
9,642,635 B2 5/2017 Vale et al.
9,642,639 B2 5/2017 Brady et al.
9,687,245 B2 6/2017 Molaei et al.
9,692,557 B2 6/2017 Murphy
9,700,332 B2 7/2017 Marchand et al.
9,706,998 B2 7/2017 Dickinson et al.
9,707,002 B2 7/2017 Henkes et al.
9,713,475 B2 7/2017 Divino et al.
9,717,519 B2 8/2017 Rosenbluth et al.
9,763,665 B2 9/2017 Riina et al.
9,782,201 B2 10/2017 Dickinson et al.
9,801,644 B2 10/2017 Ulm, III
9,833,253 B1 12/2017 Ulm, III
9,844,387 B2 12/2017 Marchand et al.
9,848,975 B2 12/2017 Hauser
9,907,643 B2 3/2018 Kusleika et al.
9,943,427 B2 4/2018 Losordo et al.
9,962,164 B2 5/2018 Losordo et al.
9,993,257 B2 6/2018 Losordo et al.
10,004,531 B2 6/2018 Rosenbluth et al.
10,016,211 B2 7/2018 Ferrera et al.
10,016,266 B2 7/2018 Hauser
10,034,680 B2 7/2018 Brady et al.
10,045,790 B2 8/2018 Cox et al.
10,070,878 B2 9/2018 Ma
10,080,575 B2 9/2018 Brady et al.
10,098,651 B2 10/2018 Marchand et al.
10,123,803 B2 11/2018 Ferrera et al.
10,123,804 B2 11/2018 Cam et al.
10,136,987 B2 11/2018 Dickinson et al.
10,201,360 B2 2/2019 Vale et al.
10,238,406 B2 3/2019 Cox et al.
10,265,085 B2 4/2019 Zaidat
10,265,086 B2 4/2019 Vale et al.
10,271,978 B2 4/2019 Wainwright et al.
10,278,717 B2 5/2019 Brady et al.
10,285,720 B2 5/2019 Gilvarry et al.
10,285,800 B2 5/2019 Dickinson et al.
10,292,722 B2 5/2019 Brady et al.
10,292,723 B2 5/2019 Brady et al.
10,299,811 B2 5/2019 Brady et al.
10,314,593 B2 6/2019 Bardsley et al.
10,327,781 B2 6/2019 Divino et al.
10,335,186 B2 7/2019 Rosenbluth et al.
10,342,571 B2 7/2019 Marchand et al.
10,349,960 B2 7/2019 Quick
10,357,265 B2 7/2019 Brady et al.
10,363,054 B2 7/2019 Vale et al.
10,390,850 B2 8/2019 Vale et al.
10,390,933 B2 8/2019 Dickinson et al.
10,398,580 B2 9/2019 Dickinson et al.
10,405,967 B1 9/2019 Dickinson et al.
10,420,570 B2 9/2019 Vale et al.
10,426,644 B2 10/2019 Shrivastava et al.
10,433,853 B2 10/2019 Divino et al.
10,433,992 B2 10/2019 Wang et al.
10,441,301 B2 10/2019 Vale et al.
10,456,151 B2 10/2019 Slee et al.
10,478,194 B2 11/2019 Rhee et al.
10,512,469 B2 12/2019 Sutherland et al.
10,517,617 B2 12/2019 Aklog et al.
10,517,622 B2 12/2019 Vale et al.

(56) References Cited

U.S. PATENT DOCUMENTS

| | | | |
|---|---|---|---|
| 10,524,811 | B2 | 1/2020 | Marchand et al. |
| 10,524,894 | B1 | 1/2020 | Dickinson et al. |
| 10,543,308 | B2 | 1/2020 | Lenihan et al. |
| 10,548,707 | B2 | 2/2020 | Zaver et al. |
| 10,582,939 | B2 | 3/2020 | Brady et al. |
| 10,588,648 | B2 | 3/2020 | Brady et al. |
| 10,588,649 | B2 | 3/2020 | Brady et al. |
| 10,588,655 | B2 | 3/2020 | Rosenbluth et al. |
| 10,596,356 | B2 | 3/2020 | Lenihan et al. |
| 10,610,246 | B2 | 4/2020 | Brady et al. |
| 10,617,435 | B2 | 4/2020 | Vale et al. |
| 10,653,426 | B2 | 5/2020 | Yang et al. |
| 10,653,434 | B1 | 5/2020 | Yang et al. |
| 10,667,833 | B2 | 6/2020 | Vale et al. |
| 10,675,045 | B2 | 6/2020 | Brady et al. |
| 10,682,152 | B2 | 6/2020 | Vale et al. |
| 10,682,493 | B2 | 6/2020 | Tran et al. |
| 10,695,159 | B2 | 6/2020 | Hauser |
| 10,709,471 | B2 | 7/2020 | Rosenbluth et al. |
| 10,722,257 | B2 | 7/2020 | Skillrud et al. |
| 10,743,894 | B2 | 8/2020 | Brady et al. |
| 10,743,895 | B2 | 8/2020 | Losordo et al. |
| 10,772,649 | B2 | 9/2020 | Hansen et al. |
| 10,786,270 | B2 | 9/2020 | Yang et al. |
| 10,792,055 | B2 | 10/2020 | Brady et al. |
| 10,792,056 | B2 | 10/2020 | Vale et al. |
| 10,799,331 | B2 | 10/2020 | Hauser |
| 10,806,611 | B2 | 10/2020 | Cam et al. |
| 10,828,040 | B2 | 11/2020 | Henkes et al. |
| 10,832,396 | B2 | 11/2020 | Duffy et al. |
| 10,835,257 | B2 | 11/2020 | Ferrera et al. |
| 10,835,271 | B2 | 11/2020 | Ma |
| 10,835,367 | B2 | 11/2020 | Dickinson et al. |
| 10,842,498 | B2 | 11/2020 | Vale et al. |
| 10,912,577 | B2 | 2/2021 | Marchand et al. |
| 10,932,802 | B2 | 3/2021 | Goyal |
| 10,952,760 | B2 | 3/2021 | Brady et al. |
| 11,000,682 | B2 | 5/2021 | Merritt et al. |
| 11,045,204 | B2 | 6/2021 | Cam et al. |
| 11,051,928 | B2 | 7/2021 | Casey et al. |
| 11,058,445 | B2 | 7/2021 | Cox et al. |
| 11,058,451 | B2 | 7/2021 | Marchand et al. |
| 11,065,018 | B2 | 7/2021 | Buck et al. |
| 11,076,876 | B2 | 8/2021 | Vale |
| 11,077,129 | B2 | 8/2021 | Sauve et al. |
| 11,077,135 | B2 | 8/2021 | Baker et al. |
| 11,077,138 | B2 | 8/2021 | Kang |
| 11,077,188 | B2 | 8/2021 | Kauvar et al. |
| 11,077,285 | B2 | 8/2021 | Martin |
| 11,083,475 | B2 | 8/2021 | Kovarik et al. |
| 11,084,778 | B2 | 8/2021 | Pelletier et al. |
| 11,085,083 | B2 | 8/2021 | Barbeau et al. |
| 11,088,440 | B2 | 8/2021 | Mccaughey et al. |
| 11,090,466 | B1 | 8/2021 | Nicholson |
| 11,090,737 | B2 | 8/2021 | Filho et al. |
| 11,096,712 | B2 | 8/2021 | Teigen et al. |
| 11,103,264 | B2 | 8/2021 | Vale et al. |
| 11,103,265 | B2 | 8/2021 | Wallace et al. |
| 11,103,627 | B2 | 8/2021 | Garrison et al. |
| 11,103,728 | B2 | 8/2021 | Wang |
| 11,103,730 | B2 | 8/2021 | Zwart et al. |
| 11,110,088 | B2 | 9/2021 | Barf et al. |
| 11,110,524 | B2 | 9/2021 | Fang et al. |
| 11,111,475 | B2 | 9/2021 | Stice et al. |
| 11,114,269 | B2 | 9/2021 | Bertsche et al. |
| 11,116,509 | B2 | 9/2021 | Follmer et al. |
| 11,116,784 | B2 | 9/2021 | Parikh |
| 11,116,943 | B2 | 9/2021 | Deaton et al. |
| 11,123,089 | B2 | 9/2021 | Ma |
| 11,123,090 | B2 | 9/2021 | Yang et al. |
| 11,123,302 | B2 | 9/2021 | Dayton et al. |
| 11,123,366 | B1 | 9/2021 | Taraman et al. |
| 11,124,536 | B2 | 9/2021 | Haydon et al. |
| 11,127,173 | B2 | 9/2021 | Schafer et al. |
| 11,129,965 | B2 | 9/2021 | Humbert et al. |
| 11,134,859 | B2 | 10/2021 | Strasser et al. |
| 11,135,259 | B2 | 10/2021 | Wu et al. |
| 11,141,071 | B2 | 10/2021 | Moore et al. |
| 11,141,178 | B2 | 10/2021 | Aboytes |
| 11,141,526 | B2 | 10/2021 | Amato et al. |
| 11,143,352 | B1 | 10/2021 | Tatarian |
| 11,145,110 | B2 | 10/2021 | Story |
| 11,147,540 | B2 | 10/2021 | Meyering et al. |
| 11,147,571 | B2 | 10/2021 | Cox et al. |
| 11,147,572 | B2 | 10/2021 | Vale et al. |
| 11,147,699 | B2 | 10/2021 | Chou et al. |
| 11,147,890 | B2 | 10/2021 | Polizzotti et al. |
| 11,147,949 | B2 | 10/2021 | Yang et al. |
| 11,147,985 | B2 | 10/2021 | Isola et al. |
| 11,148,213 | B2 | 10/2021 | Bookheimer et al. |
| 11,149,922 | B1 | 10/2021 | Reyes |
| 11,150,318 | B2 | 10/2021 | Remelius |
| 11,150,561 | B2 | 10/2021 | Cho et al. |
| 11,154,269 | B2 | 10/2021 | Shea et al. |
| 11,154,314 | B2 | 10/2021 | Quick |
| 11,154,356 | B2 | 10/2021 | Gertner |
| 11,160,526 | B2 | 11/2021 | Yu et al. |
| 11,160,572 | B2 | 11/2021 | Ulm, III |
| 11,160,953 | B2 | 11/2021 | Shimada et al. |
| 11,191,558 | B2 | 12/2021 | Nguyen et al. |
| 11,197,683 | B1 | 12/2021 | Teigen et al. |
| 11,241,304 | B2 | 2/2022 | Dickinson et al. |
| 11,246,612 | B2 | 2/2022 | Brady et al. |
| 11,253,278 | B2 | 2/2022 | Casey et al. |
| 11,259,824 | B2 | 3/2022 | Brady et al. |
| 11,266,427 | B2 | 3/2022 | Duffy |
| 11,272,945 | B2 | 3/2022 | Shrivastava et al. |
| 11,311,304 | B2 | 4/2022 | Kelly et al. |
| 11,311,700 | B2 | 4/2022 | Deaton et al. |
| 11,357,510 | B2 | 6/2022 | Rhee et al. |
| 11,382,778 | B2 | 7/2022 | Liebig et al. |
| 11,395,667 | B2 | 7/2022 | Vale et al. |
| 11,406,403 | B2 | 8/2022 | Casey et al. |
| 11,406,416 | B2 | 8/2022 | Casey et al. |
| 11,433,218 | B2 | 9/2022 | Quick et al. |
| 11,446,045 | B2 | 9/2022 | Vale et al. |
| 11,446,170 | B2 | 9/2022 | Dickinson et al. |
| 11,452,841 | B2 | 9/2022 | Jalgaonkar et al. |
| 11,457,927 | B2 | 10/2022 | Sutherland et al. |
| 11,464,528 | B2 | 10/2022 | Brady et al. |
| 11,471,262 | B2 | 10/2022 | Dickinson et al. |
| 11,478,614 | B2 | 10/2022 | Deaton et al. |
| 11,484,328 | B2 | 11/2022 | Gilvarry et al. |
| 11,523,838 | B2 | 12/2022 | Nguyen et al. |
| 11,529,156 | B2 | 12/2022 | Slee et al. |
| 11,529,157 | B2 | 12/2022 | Brady et al. |
| 11,529,158 | B2 | 12/2022 | Hauser |
| 11,547,427 | B2 | 1/2023 | Vale et al. |
| 11,554,005 | B2 | 1/2023 | Merritt et al. |
| 11,559,382 | B2 | 1/2023 | Merritt et al. |
| 11,596,414 | B2 | 3/2023 | Divino et al. |
| 11,612,397 | B2 | 3/2023 | Hettel et al. |
| 11,642,145 | B2 | 5/2023 | Vale et al. |
| 11,642,209 | B2 | 5/2023 | Merritt et al. |
| 11,648,028 | B2 | 5/2023 | Rosenbluth et al. |
| 11,660,426 | B2 | 5/2023 | Nitzan et al. |
| 11,690,628 | B2 | 7/2023 | Divino et al. |
| 11,690,741 | B2 | 7/2023 | Cam et al. |
| 11,697,011 | B2 | 7/2023 | Merritt et al. |
| 11,697,012 | B2 | 7/2023 | Merritt et al. |
| 11,712,256 | B2 | 8/2023 | Vale et al. |
| 11,744,691 | B2 | 9/2023 | Merritt et al. |
| 11,779,364 | B2 | 10/2023 | Casey et al. |
| 11,786,253 | B2 | 10/2023 | Divino et al. |
| 11,786,254 | B2 | 10/2023 | Ferrera et al. |
| 11,806,033 | B2 | 11/2023 | Marchand et al. |
| 11,832,837 | B2 | 12/2023 | Hauser |
| 11,832,838 | B2 | 12/2023 | Hauser |
| 11,833,023 | B2 | 12/2023 | Merritt et al. |
| 11,839,392 | B2 | 12/2023 | Brady et al. |
| 11,839,393 | B2 | 12/2023 | Hauser |
| 11,839,725 | B2 | 12/2023 | Casey et al. |
| 11,844,921 | B2 | 12/2023 | Merritt et al. |
| 11,849,963 | B2 | 12/2023 | Quick |

(56) References Cited

U.S. PATENT DOCUMENTS 11,850,379 B2 12/2023 Humbert et al.
11,857,209 B2 1/2024 Choe et al.
11,857,210 B2 1/2024 Vale et al.
11,864,770 B2 1/2024 Bardsley et al.
11,864,779 B2 1/2024 Dinh
11,864,781 B2 1/2024 Shalgi et al.
11,865,291 B2 1/2024 Merritt et al.
11,871,945 B2 1/2024 Brady et al.
11,871,947 B2 1/2024 Losordo et al.
11,871,949 B2 1/2024 Brady et al.
11,883,046 B2 1/2024 Casey et al.
11,890,180 B2 2/2024 Merritt et al.
11,918,243 B2 3/2024 Marchand et al.
11,918,244 B2 3/2024 Marchand et al.
11,925,369 B2 3/2024 Hauser
11,937,834 B2 3/2024 Dinh
11,937,835 B2 3/2024 Vale et al.
11,937,838 B2 3/2024 Cox et al.
11,944,327 B2 4/2024 Vale et al.
11,944,333 B2 4/2024 Vale
11,963,693 B2 4/2024 Casey et al.
11,963,861 B2 4/2024 Strauss et al.
11,969,178 B2 4/2024 Hauser
11,969,331 B2 4/2024 Merritt et al.
11,969,332 B2 4/2024 Merritt et al.
11,969,333 B2 4/2024 Merritt et al.
11,974,909 B2 5/2024 Merritt et al.
11,974,910 B2 5/2024 Merritt et al.
11,980,379 B2 5/2024 Casey et al.
11,980,537 B2 5/2024 Merritt et al.
11,986,382 B2 5/2024 Merritt et al.
11,998,223 B2 6/2024 Brady et al.
11,998,436 B2 6/2024 Merritt et al.
12,016,580 B2 6/2024 Quick et al.
12,016,582 B2 6/2024 Nguyen et al.
12,023,057 B2 7/2024 Hauser
12,029,441 B2 7/2024 Bhogal et al.
12,285,182 B2 * 4/2025 Shrivastava ..... A61B 17/221
2004/0078334 A1 4/2004 Malcolm et al.
2005/0128096 A1 6/2005 Adams
2005/0227243 A1 10/2005 Deak et al.
2005/0277976 A1 12/2005 Galdonik et al.
2006/0187035 A1 8/2006 Adams
2007/0010787 A1 1/2007 Hackett et al.
2007/0269433 A1 11/2007 Deak et al.
2007/0287956 A1 12/2007 Tal
2008/0172717 A1 7/2008 Malcolm
2008/0301297 A1 12/2008 Malcolm et al.
2008/0301454 A1 12/2008 Malcolm et al.
2009/0024072 A1 1/2009 Criado et al.
2010/0042118 A1 2/2010 Garrison et al.
2013/0197567 A1 8/2013 Brady et al.
2013/0345739 A1 * 12/2013 Brady ..... A61B 17/320725 606/200
2014/0180397 A1 6/2014 Gerberding et al.
2014/0200608 A1 7/2014 Brady et al.
2014/0277079 A1 9/2014 Vale et al.
2014/0288588 A1 * 9/2014 Lam ..... A61F 2/0105 29/428
2014/0371769 A1 12/2014 Vale et al.
2014/0371779 A1 12/2014 Vale et al.
2014/0371780 A1 12/2014 Vale et al.
2014/0379023 A1 12/2014 Brady et al.
2015/0147520 A1 5/2015 Grau
2015/0164523 A1 6/2015 Brady et al.
2015/0173782 A1 6/2015 Garrison et al.
2015/0190156 A1 * 7/2015 Ulm, III ..... A61B 17/221 606/200
2015/0257775 A1 9/2015 Gilvarry et al.
2015/0359547 A1 12/2015 Vale et al.
2015/0374393 A1 12/2015 Brady et al.
2015/0374479 A1 12/2015 Vale
2016/0015402 A1 1/2016 Brady et al.
2016/0022296 A1 1/2016 Brady et al.
2016/0066921 A1 3/2016 Seifert et al.
2016/0106448 A1 4/2016 Brady et al.
2016/0106449 A1 4/2016 Brady et al.
2016/0113663 A1 4/2016 Brady et al.
2016/0113664 A1 4/2016 Brady et al.
2016/0113665 A1 4/2016 Brady et al.
2016/0120558 A1 5/2016 Brady et al.
2016/0143653 A1 5/2016 Vale et al.
2016/0151550 A1 6/2016 Fisher et al.
2016/0192953 A1 7/2016 Brady et al.
2016/0192954 A1 7/2016 Brady et al.
2016/0192955 A1 7/2016 Brady et al.
2016/0192956 A1 7/2016 Brady et al.
2016/0256180 A1 9/2016 Vald et al.
2016/0317168 A1 11/2016 Brady et al.
2016/0378943 A1 12/2016 Vallee
2017/0043066 A1 2/2017 Laub
2017/0071614 A1 3/2017 Vale et al.
2017/0086862 A1 3/2017 Vale et al.
2017/0086863 A1 3/2017 Brady et al.
2017/0105743 A1 4/2017 Vale et al.
2017/0112515 A1 4/2017 Brady et al.
2017/0215903 A1 8/2017 Vale et al.
2017/0265878 A1 9/2017 Marchand et al.
2018/0052965 A1 2/2018 Tumkur et al.
2018/0092652 A1 4/2018 Marchand et al.
2018/0132876 A1 5/2018 Zaidat
2018/0193026 A1 7/2018 Yang et al.
2018/0193043 A1 7/2018 Marchand et al.
2018/0263632 A1 9/2018 Seifert et al.
2018/0280623 A1 10/2018 Pilkington et al.
2018/0296240 A1 10/2018 Rosenbluth et al.
2018/0344338 A1 12/2018 Brady et al.
2018/0344339 A1 12/2018 Cox et al.
2018/0360483 A1 12/2018 Brady et al.
2018/0361116 A1 12/2018 Quick et al.
2019/0000492 A1 1/2019 Casey et al.
2019/0046219 A1 2/2019 Marchand et al.
2019/0070401 A1 3/2019 Merritt et al.
2019/0142442 A1 5/2019 Vale et al.
2019/0150959 A1 5/2019 Cox et al.
2019/0167287 A1 6/2019 Vale
2019/0201014 A1 7/2019 Vale
2019/0223893 A1 7/2019 Gilvarry et al.
2019/0231372 A1 8/2019 Brady et al.
2019/0231373 A1 8/2019 Quick
2019/0239907 A1 8/2019 Brady et al.
2019/0239908 A1 8/2019 Brady et al.
2019/0239910 A1 8/2019 Brady et al.
2019/0239911 A1 8/2019 Zaidat
2019/0298397 A1 10/2019 Vale et al.
2019/0321071 A1 10/2019 Marchand et al.
2019/0328411 A1 10/2019 Vale et al.
2019/0336151 A1 11/2019 Vale et al.
2019/0365399 A1 12/2019 Vale et al.
2019/0374238 A1 12/2019 Vale et al.
2019/0381223 A1 12/2019 Culbert et al.
2020/0000483 A1 1/2020 Brady et al.
2020/0001046 A1 1/2020 Yang et al.
2020/0008820 A1 1/2020 Aboytes et al.
2020/0009301 A1 1/2020 Yee
2020/0046368 A1 2/2020 Merritt et al.
2020/0046390 A1 2/2020 Brady et al.
2020/0060703 A1 2/2020 Vale et al.
2020/0069889 A1 3/2020 Lin
2020/0085444 A1 3/2020 Vale et al.
2020/0100804 A1 4/2020 Casey et al.
2020/0107851 A1 4/2020 Mccarthy
2020/0121339 A1 4/2020 Brady et al.
2020/0126212 A1 4/2020 Duffy et al.
2020/0138460 A1 5/2020 Yang et al.
2020/0155181 A1 5/2020 Yang et al.
2020/0155293 A1 5/2020 Morrison et al.
2020/0205845 A1 7/2020 Yang et al.
2020/0246031 A1 8/2020 Vale et al.
2020/0281611 A1 9/2020 Kelly et al.
2020/0281612 A1 9/2020 Kelly et al.
2020/0289136 A1 9/2020 Chou
2020/0297972 A1 9/2020 Yee et al.
2020/0305900 A1 10/2020 Vale et al.

(56) References Cited

U.S. PATENT DOCUMENTS

| | | | |
|---|---|---|---|
| 2020/0306501 | A1 | 10/2020 | Yee et al. |
| 2020/0323615 | A1 | 10/2020 | Casey et al. |
| 2020/0345904 | A1 | 11/2020 | Casey et al. |
| 2020/0353205 | A1 | 11/2020 | Kelly et al. |
| 2020/0353226 | A1 | 11/2020 | Keating et al. |
| 2020/0353228 | A1 | 11/2020 | Casey et al. |
| 2020/0353229 | A1 | 11/2020 | Casey et al. |
| 2020/0390459 | A1 | 12/2020 | Casey et al. |
| 2020/0390460 | A9 | 12/2020 | Casey et al. |
| 2020/0390515 | A1 | 12/2020 | Lorenzo |
| 2021/0007757 | A1 | 1/2021 | Casey et al. |
| 2021/0038227 | A1 | 2/2021 | Vale et al. |
| 2021/0069468 | A1 | 3/2021 | Keating et al. |
| 2021/0077134 | A1 | 3/2021 | Vale et al. |
| 2021/0106238 | A1 | 4/2021 | Strasser et al. |
| 2021/0113224 | A1 | 4/2021 | Dinh |
| 2021/0121165 | A1 | 4/2021 | Duffy et al. |
| 2021/0128183 | A1 | 5/2021 | Lee |
| 2021/0145447 | A1 | 5/2021 | Stefanov |
| 2021/0153883 | A1 | 5/2021 | Casey et al. |
| 2021/0153884 | A1 | 5/2021 | Casey et al. |
| 2021/0154433 | A1 | 5/2021 | Casey et al. |
| 2021/0154443 | A1 | 5/2021 | Casey |
| 2021/0161544 | A1 | 6/2021 | Casey |
| 2021/0186536 | A1 | 6/2021 | Buck et al. |
| 2021/0186537 | A1 | 6/2021 | Buck et al. |
| 2021/0186541 | A1 | 6/2021 | Thress |
| 2021/0186542 | A1 | 6/2021 | Buck et al. |
| 2021/0187244 | A1 | 6/2021 | Buck et al. |
| 2021/0187264 | A1 | 6/2021 | Lee et al. |
| 2021/0196292 | A1 | 7/2021 | Vale |
| 2021/0228223 | A1 | 7/2021 | Casey et al. |
| 2021/0236148 | A1 | 8/2021 | Marchand et al. |
| 2021/0259720 | A1 | 8/2021 | Brady et al. |
| 2021/0267745 | A1 | 9/2021 | Walzman |
| 2021/0268311 | A1 | 9/2021 | Park et al. |
| 2021/0268591 | A1 | 9/2021 | Filho et al. |
| 2021/0270847 | A1 | 9/2021 | Wang et al. |
| 2021/0274635 | A1 | 9/2021 | Cooley et al. |
| 2021/0275197 | A1 | 9/2021 | Vale et al. |
| 2021/0275198 | A1 | 9/2021 | Keating et al. |
| 2021/0275783 | A1 | 9/2021 | Johnson et al. |
| 2021/0275833 | A1 | 9/2021 | Krishnaswamy et al. |
| 2021/0277052 | A1 | 9/2021 | Gewirth et al. |
| 2021/0277453 | A1 | 9/2021 | Shapiro et al. |
| 2021/0282735 | A1 | 9/2021 | Wiggers et al. |
| 2021/0282944 | A1 | 9/2021 | Chen et al. |
| 2021/0283080 | A1 | 9/2021 | Gwag et al. |
| 2021/0283426 | A1 | 9/2021 | Carabe-Fernandez et al. |
| 2021/0286845 | A1 | 9/2021 | Dowler et al. |
| 2021/0290194 | A1 | 9/2021 | Bai et al. |
| 2021/0290822 | A1 | 9/2021 | Seal et al. |
| 2021/0290907 | A1 | 9/2021 | Martin |
| 2021/0290925 | A1 | 9/2021 | Merritt et al. |
| 2021/0290979 | A1 | 9/2021 | Liu et al. |
| 2021/0291280 | A1 | 9/2021 | Silva et al. |
| 2021/0292293 | A1 | 9/2021 | Kusama et al. |
| 2021/0295339 | A1 | 9/2021 | Adjaoute |
| 2021/0295590 | A1 | 9/2021 | Decell et al. |
| 2021/0296303 | A1 | 9/2021 | Cho et al. |
| 2021/0298601 | A1 | 9/2021 | Federoff et al. |
| 2021/0298889 | A1 | 9/2021 | Casey et al. |
| 2021/0299214 | A1 | 9/2021 | Jay et al. |
| 2021/0299435 | A1 | 9/2021 | Simon et al. |
| 2021/0304402 | A1 | 9/2021 | Morgas et al. |
| 2021/0307766 | A1 | 10/2021 | Keating et al. |
| 2021/0308209 | A1 | 10/2021 | Tymianski |
| 2021/0308358 | A1 | 10/2021 | Raman et al. |
| 2021/0308486 | A1 | 10/2021 | Perez et al. |
| 2021/0309730 | A1 | 10/2021 | Schaefer et al. |
| 2021/0315594 | A1 | 10/2021 | Kallmes et al. |
| 2021/0315596 | A1 | 10/2021 | Buck et al. |
| 2021/0315597 | A1 | 10/2021 | Buck et al. |
| 2021/0315598 | A1 | 10/2021 | Buck et al. |
| 2021/0315599 | A1 | 10/2021 | Vale et al. |
| 2021/0316116 | A1 | 10/2021 | Kallmes et al. |
| 2021/0316121 | A1 | 10/2021 | Buck et al. |
| 2021/0316127 | A1 | 10/2021 | Buck et al. |
| 2021/0316158 | A1 | 10/2021 | Shaw et al. |
| 2021/0316376 | A1 | 10/2021 | Filho et al. |
| 2021/0316500 | A1 | 10/2021 | Skelton et al. |
| 2021/0321961 | A1 | 10/2021 | Harrison et al. |
| 2021/0322036 | A1 | 10/2021 | Anushree et al. |
| 2021/0322037 | A1 | 10/2021 | Anushree et al. |
| 2021/0322038 | A1 | 10/2021 | Dwivedi et al. |
| 2021/0322773 | A1 | 10/2021 | Beufer et al. |
| 2021/0322787 | A1 | 10/2021 | Stahl et al. |
| 2021/0323082 | A1 | 10/2021 | Bookheimer et al. |
| 2021/0323955 | A1 | 10/2021 | Panicker et al. |
| 2021/0326932 | A1 | 10/2021 | Chu |
| 2021/0330332 | A1 | 10/2021 | Chou et al. |
| 2021/0330344 | A1 | 10/2021 | Rosenbluth et al. |
| 2021/0330371 | A1 | 10/2021 | Gunther et al. |
| 2021/0334960 | A1 | 10/2021 | Arnold et al. |
| 2021/0338256 | A1 | 11/2021 | Chou et al. |
| 2021/0338854 | A1 | 11/2021 | Nissenbaum et al. |
| 2021/0340341 | A1 | 11/2021 | Jackson et al. |
| 2021/0341180 | A1 | 11/2021 | Kirscht |
| 2021/0378694 | A1 | 12/2021 | Thress et al. |
| 2022/0039815 | A1 | 2/2022 | Thress et al. |
| 2022/0142638 | A1 | 5/2022 | Enright et al. |
| 2022/0151647 | A1 | 5/2022 | Dolendo et al. |
| 2022/0152355 | A1 | 5/2022 | Dolendo et al. |
| 2022/0346813 | A1 | 11/2022 | Quick |
| 2023/0218310 | A1 | 7/2023 | Scheinblum et al. |
| 2023/0218313 | A1 | 7/2023 | Rosenbluth et al. |
| 2023/0240706 | A1 | 8/2023 | Rosenbluth et al. |
| 2023/0241302 | A1 | 8/2023 | Merritt et al. |
| 2023/0248380 | A1 | 8/2023 | Long et al. |
| 2023/0310137 | A1 | 10/2023 | Merritt et al. |
| 2023/0310751 | A1 | 10/2023 | Merritt et al. |
| 2023/0329734 | A1 | 10/2023 | Marchand et al. |
| 2023/0355256 | A1 | 11/2023 | Dinh |
| 2023/0355938 | A1 | 11/2023 | Merritt et al. |
| 2023/0363776 | A1 | 11/2023 | Quick |
| 2023/0389932 | A1 | 12/2023 | Ozenne et al. |
| 2024/0074771 | A1 | 3/2024 | Quick et al. |
| 2024/0082540 | A1 | 3/2024 | Brodt et al. |
| 2024/0157041 | A1 | 5/2024 | Zikry et al. |
| 2024/0198072 | A1 | 6/2024 | Merritt et al. |
| 2024/0207593 | A1 | 6/2024 | Merritt et al. |
| 2024/0225674 | A1 | 7/2024 | Dederich et al. |

FOREIGN PATENT DOCUMENTS

| | | | |
|---|---|---|---|
| CN | 108601599 | B | 8/2021 |
| CN | 111012443 | B | 9/2022 |
| EP | 3593742 | A1 | 1/2020 |
| EP | 3335647 | B1 | 1/2022 |
| ES | 2932031 | T3 | 1/2023 |
| JP | 7389159 | B2 | 11/2023 |
| WO | 2018/019829 | A1 | 2/2018 |

OTHER PUBLICATIONS

Merit Medical, "ASAP Aspiration Cather", Instructions for Use, in English, French, Spanish and Portuguese Languages, Received on Nov. 19, 2024, 7 pages.

Merit Medical, "ASAP Aspiration Cather", Online Available at: https://www.youtube.com/watch?v=rYxNUN_uRXE, Retrieved on Nov. 21, 2024, 3 pages.

Deak et al., "Rotational thrombectomy of acute peripheral vascular occlusions using the ThromCat XT device: techniques, indications and initial results", Diagnostic and Interventional Radiology, vol. 17, No. 3, Sep. 2011, Online Available at: https://doi.org/10.4621/1305-3825.DIR.3687-10.2, pp. 283-289.

De Marini et al., "A Direct Aspiration First Pass Technique with The New ARC Catheter for Thrombectomy of Large Vessel Occlusion Strokes: A Multicenter Study", vol. 25, Issue 2, World Federation of Interventional and Therapeutic Neuroradiology, Oct. 5, 2018, Online Available at: https://doi.org/10.1177/1591019918803962, pp. 187-193.

(56) References Cited

OTHER PUBLICATIONS

Donaldson et al., "Thrombectomy Using Suction Filtration and Veno-Venous Bypass: Single Center Experience With A Novel Device", vol. 86, Issue 2, online available at: https://doi.org/10.1002/ccd.25583, pp. E81-E87.
Froehler, Michael T., "Comparison of Vacuum Pressures and Forces Generated by Different Catheters and Pumps for Aspiration Thrombectomy in Acute Ischemic Stroke", Interventional Neurology, vol. 6, Issue 3-4, Oct. 2017, Online Available at: https://doi.org/10.1159/000475478, pp. 199-206.
Heberlein et al., "New Generation Aspiration Catheter: Feasibility in The Treatment of Pulmonary Embolism", World Journal of Radiology, vol. 5, Issue 11, Nov. 18, 2013, pp. 430-435.
Möhlenbruch et al., "Multicenter Experience with The New SOFIA Plus Catheter As A Primary Local Aspiration Catheter For Acute Stroke Thrombectomy", Journal of Neurointerventional Surgery, vol. 9, Issue 12, Dec. 2017, Online Available at: https://doi.org/10.1136/neurintsurg-2016-012812, pp. 1223-1227.
Nikoubashman et al., "Necessary Catheter Diameters for Mechanical Thrombectomy with ADAPT", American Journal of Neuroradiology, vol. 38 Issue 12, Aug. 29, 2024, pp. 2277-2281.
Nikoubashman et al., "Under Pressure: Comparison of Aspiration Techniques for Endovascular Mechanical Thrombectomy", American Journal of Neuroradiology, vol. 39, May 2018, pp. 905-909.
Turk et al., "Adapt Fast Study: A Direct Aspiration first Pass Technique for Acute Stroke Thrombectomy", Journal of Neurointerventional Surgery, vol. 6, 2014, pp. 260-264.
Zehnder et al., "Percutaneous Catheter Thrombus Aspiration for Acute or Subacute Arterial Occlusion of the Legs: How Much Thrombolysis is Needed?", European Journal of Vascular and Endovascular Surgery, vol. 20, 2000, pp. 41-46.
WIPO, "International Search Report and Written Opinion" issued in connection with PCT Patent Application PCT/US2023/064167, dated Oct. 20, 2023, 13 pages.
Shani et al., "Mechanical Manipulation of Thrombus: Coronary Thrombectomy," Intracoronary Clot Displacement, and Transcatheter Aspiration, American Journal of Cardiology, vol. 72, Dec. 16, 1993, p. 116G-118G.
Bose et al., "The Penumbra System: A Mechanical Device for the Treatment of Acute Stroke due to Thromboembolism", American Journal of Neuroradiology. vol. 29, Aug. 2008, pp. 1409-1413.
Turk et al., "Initial Clinical Experience with The ADAPT Technique: A Direct Aspiration First Pass Technique for Stroke Thrombectomy," Journal of NeuroInterventional Surgery, 2013, 9 pages.
Turk III et al., "Aspiration Thrombectomy Versus Stent Retriever Thrombectomy As First-Line Approach For Large Vessel Occlusion (Compass): A Multicentre, Randomized, Open Label, Blinded Outcome, Non-Inferiority Trial", Lancet, vol. 393, Mar. 9, 2019, pp. 998-1008.
Saver, Jeffrey L., "Time is Brain—Quantified," Stroke, Center and Department of Neurology, vol. 37, 2006, pp. 263-266.
Horowitz et al., "In Vitro Proof of Concept Evaluation of a Gravity Powered Novel Filtration Device to Effectively Process a Blood Analogue/Particle Mixture to Rapidly Produce a Clear Filtrate", Cardiology and Cardiovascular Medicine, Fortune Journals, vol. 8, Issue 1, 2004, pp. 48-51.
Horowitz et al., "Extra-Corporeal Processing of Bovine, Porcine and Human Blood in Preparation for Autologous Re-Infusion Using a Disposable Filtration System: Initial Proof of Concept Study and Potential Applications for Human Autologous Blood Reinfusion in the Civilian and Combat Casualty Care Settings", Journal of Biology and Today's World 2023, vol. 12, Issue 06, 2023, pp. 1-6.
USPTO, "Non-Final Office Action" issued in connection with U.S. Appl. No. 17/691,914, dated Oct. 1, 2024, 11 pages.

* cited by examiner

Clot Retriever w / Delivery Sheath

Clot Retriever and Aspiration System

TORQUEABLE DEVICES AND METHODS FOR REMOVING AN EMBOLUS

CROSS-REFERENCES TO RELATED APPLICATIONS

This application is a continuation-in-part and claims benefit of U.S. patent application Ser. No. 17/691,914 filed Mar. 10, 2022, which is a continuation in part and claims benefit of U.S. patent application Ser. No. 16/597,727 filed Oct. 9, 2019, now U.S. Pat. No. 11,272,945, which is a non-provisional application and claims benefit of U.S. Provisional Application No. 62/744,107 filed Oct. 10, 2018, the specification(s) of which is/are incorporated herein in their entirety by reference.

FIELD OF THE INVENTION

The present invention relates to the field of medical devices and methods that remove emboli.

BACKGROUND OF THE INVENTION

In recent years, clot retrieval has been proven to be a safe and effective treatment for acute ischemic stroke patients. However, despite the success of clot retrieval as a treatment for acute ischemic stroke, treatments for diseases created by the presence of large clots, such as pulmonary embolism (PE), have seen minimal progress. As a result, more than 300,000 patients are hospitalized for PE each year in the United States alone, and 100,000 deaths result from PE each year.

Pulmonary embolism often occurs when a clot formed in deep veins travels to the lungs and blocks pulmonary arteries. The presence of a pulmonary embolus can cut off blood to large portions of the lungs and be potentially fatal. Clot burden is often high, causing a blockage in the main, left and/or right pulmonary arteries and their branches. Emboli are particularly difficult to remove because they are often large and must traverse a complex and tortuous pathway to be extracted from the body using an endovascular approach. In many cases, pulmonary embolism can cause right heart strain, resulting in heart failure and death.

Pulmonary embolism differs from acute ischemic stroke in that the clot burden is often much higher. Thus, medical devices that can retrieve large clots from the body safely and quickly, thereby opening the passage for deoxygenated blood to travel to the lungs, are needed. Therefore, the present invention provides methods and devices that safely remove embolic mass from pulmonary arteries.

BRIEF SUMMARY OF THE INVENTION

It is an objective of the present invention to provide systems, devices, and methods that allow for retrieving a clot in a vessel, as specified in the independent claims. Embodiments of the invention are given in the dependent claims. Embodiments of the present invention can be freely combined with each other if they are not mutually exclusive.

In some embodiments, the present invention features a capturing basket for capturing an embolus. The capturing basket comprises a first and second basket end, a plurality of cells defined by struts, and at least four body markers disposed on the basket. In some embodiments, the struts have strut ends connected to the first and second basket ends.

In some embodiments, the present invention features a torquable clot retrieval device. The torquable clot retrieval device may comprise a delivery shaft (e.g., a pusher) and a capturing basket. The delivery shaft (e.g., a pusher) has a distal delivery shaft end. In some embodiments, the capturing basket is coupled to the distal delivery shaft end. The capturing basket comprises a first basket end, a second basket end, a plurality of cells defined by struts, and at least four body markers disposed on the basket. The struts may have strut ends connected to the first and the second basket ends. The aforementioned device is configured to transfer torque through the delivery shaft to the capturing basket. For example, when the delivery shaft is rotated, torque is transferred from the delivery shaft to the capturing basket, such that the capturing basket is also rotated.

In other embodiments, the present invention may also feature a clot retrieval device. The clot retrieval device may comprise a delivery shaft (e.g., a pusher) and a capturing basket. The delivery shaft (e.g., a pusher) has a distal delivery shaft end, and in some embodiments, the capturing basket is coupled to the distal delivery shaft end. The capturing basket comprises a first basket end, a second basket end, a plurality of cells defined by struts, and at least four body markers disposed on the basket. The struts may have strut ends that are connected to the first basket end and the second basket end.

One of the unique and inventive technical features of the present invention is the shape and dimensions of the plurality of closed cells that make up the capturing basket. Without wishing to limit the invention to any theory or mechanism, it is believed that the technical feature of the present invention advantageously provides for an embolus to ingress into the capturing basket. Additionally, the clot retrieval devices described herein are configured to withstand torque (i.e., are configured to rotate). Specifically, when the distal end of a delivery shaft (e.g., a pusher) described herein is hand-rotated (e.g., axially rotated), torque is transferred through the delivery shaft to the capturing basket, such that the capturing basket is also rotated. Without wishing to limit the invention to any theory or mechanism, it is believed that the technical feature of the present invention advantageously enables controlled shearing of the embolus by the capturing basket and allows for the capturing basket to dislodge an embolus from a vessel wall. None of the presently known prior references or work has the unique, inventive technical feature of the present invention.

Briefly, the present invention describes clot retrieval devices. In some embodiments, the clot retrieval device comprises a delivery shaft and a capturing basket coupled to the distal end of the delivery shaft. The capturing basket may feature a plurality of cells defined by struts having strut ends that are connected to the ends of the capturing basket, and at least four body markers disposed on the capturing basket.

In some embodiments, the delivery shaft is hollow. In some embodiments, the device is configured such that a guidewire can pass through the delivery shaft through the second basket end, wherein the guidewire is disposed within the capturing basket. In some embodiments, the cells at the second basket end of the capturing basket are smaller in size than the cells in the middle of the capturing basket and at the first end of the capturing basket. In some embodiments, the body markers are disposed on the struts of the capturing basket. In some embodiments, the body markers are aligned or in parallel with the struts of the capturing basket. In some embodiments, the body markers are attached to the struts at a single attachment point or wherein the body markers are attached to the struts at two attachment points. In some embodiments, the delivery shaft is able to withstand torque.

In some embodiments, the delivery shaft is configured to rotate. In some embodiments, the delivery shaft rotates at 2 to 50 rpm. In some embodiments, the delivery shaft rotates at 2 to 10 rpm. In some embodiments, when the delivery shaft is rotated, torque is transferred from the delivery shaft to the capturing basket, such that the capturing basket is also rotated. The present invention is not limited to the aforementioned features or configurations.

The present invention includes torquable clot retrieval devices. In some embodiments, the torquable clot retrieval device comprises a delivery shaft and a capturing basket coupled to the distal end of the delivery shaft. The capturing basket may feature a plurality of cells defined by struts having strut ends that are connected to the ends of the capturing basket, and at least four body markers disposed on the capturing basket. The device may be configured such that torque is transferred through the delivery shaft to the capturing basket.

In some embodiments, the delivery shaft is hollow. In some embodiments, the device is configured such that a guidewire can pass through the delivery shaft through the second basket end, wherein the guidewire is disposed within the capturing basket. In some embodiments, the cells at the second basket end of the capturing basket are smaller in size than the cells in the middle of the capturing basket and at the first end of the capturing basket. In some embodiments, the body markers are disposed on the struts of the capturing basket. In some embodiments, the body markers are aligned or in parallel with the struts of the capturing basket. In some embodiments, the body markers are attached to the struts at a single attachment point, or the body markers are attached to the struts at two attachment points, or the body markers are attached to the struts as one continuous attachment. In some embodiments, when the delivery shaft is rotated, torque is transferred from the delivery shaft to the capturing basket, such that the capturing basket is also rotated. The present invention is not limited to the aforementioned features or configurations.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWING(S)

The features and advantages of the present invention will become apparent from a consideration of the following detailed description presented in connection with the accompanying drawings in which:

FIGS. 1A and 1B show clot retrieval devices as described herein. FIG. 1A shows a schematic drawing of the clot retrieval device described herein, either comprising a delivery sheath (top) or a delivery catheter (bottom). FIG. 1B shows a clot retrieval device.

FIG. 2 shows a detailed clot retrieval device in accordance with the embodiments herein.

FIGS. 3A and 3B show various embodiments of the capturing basket described herein. FIG. 3A shows a capturing basket in which the body markers are aligned with the struts of the capturing basket. FIG. 3B shows a capturing basket in which the body markers protrude from the capturing basket's struts.

FIG. 4A shows how the clot retrieval device described herein may be divided into two portions (e.g., a distal portion or a proximal portion; top) and the dimensions of the cells (bottom).

FIGS. 4B and 4C shows non-limiting examples of how body markers described herein may be attached to the capturing basket, e.g., the body markers may be aligned with the struts of the capturing basket (left), the body markers may be in parallel with the struts of the capturing basket (e.g., may protrude from the struts of the capturing basket; middle/right), or the body markers may be attached to the struts of the capturing basket at a single attachment point (right) or two attachment points (middle) using an adjoining agent.

FIG. 5 shows an abstract diagram demonstrating non-limiting views of a capturing basket comprising a tapered diameter at one end (top, left), a consistent diameter (top, right), or a tapered diameter at both ends (bottom).

FIGS. 6A, 6B, 6C, and 6D show rudimentary diagrams of how parts of a support component described herein (e.g., a support component comprising a first support portion, a second support portion, and an inner shaft disposed through the first lumen of the first support portion and the second lumen of the second support portion) may move in accordance with embodiments herein.

FIG. 7 shows, in accordance with the embodiments herein, a delivery catheter. The catheter shaft may comprise an attached hub sub-assembly. In addition, a dilator may be used in conjunction with the catheter described herein.

DETAILED DESCRIPTION OF THE INVENTION

Figure 1A:
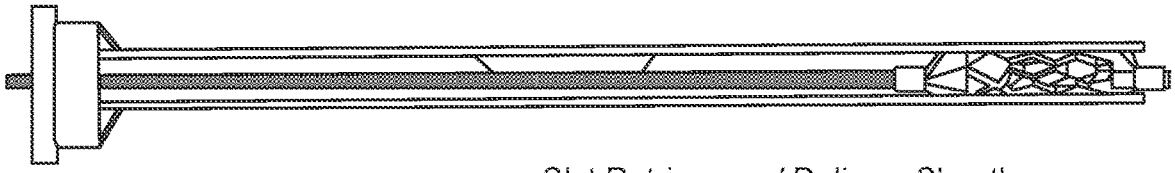
Figure 1A:
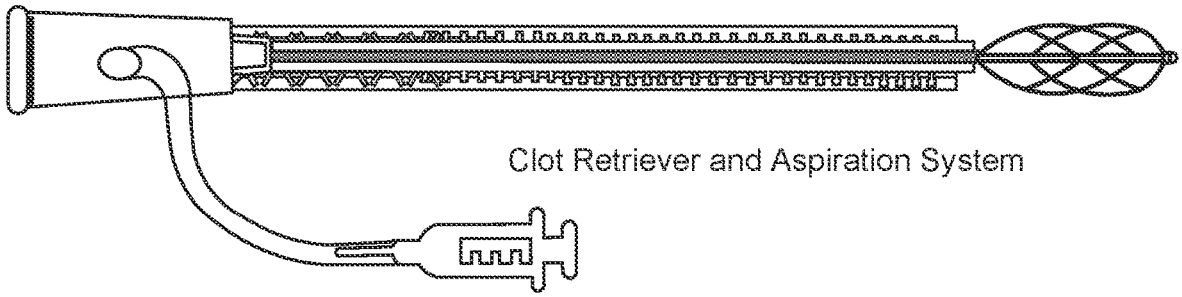
Figure 1B:
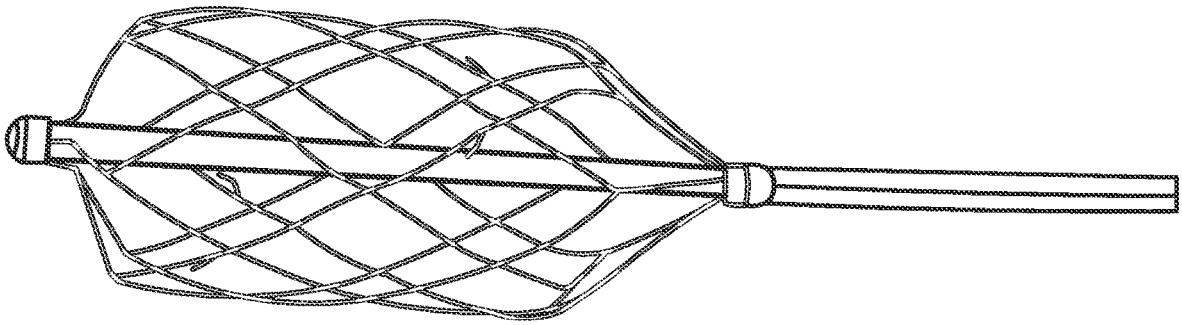
Figure 2:
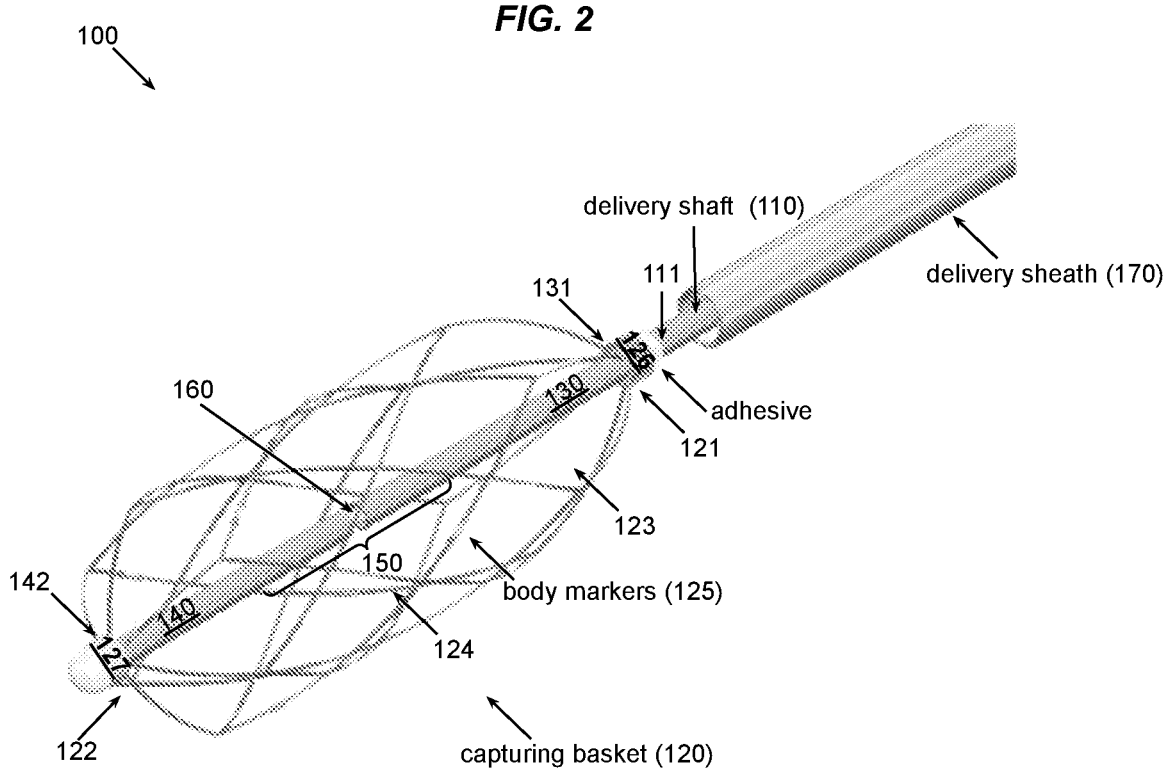
Figure 3A:
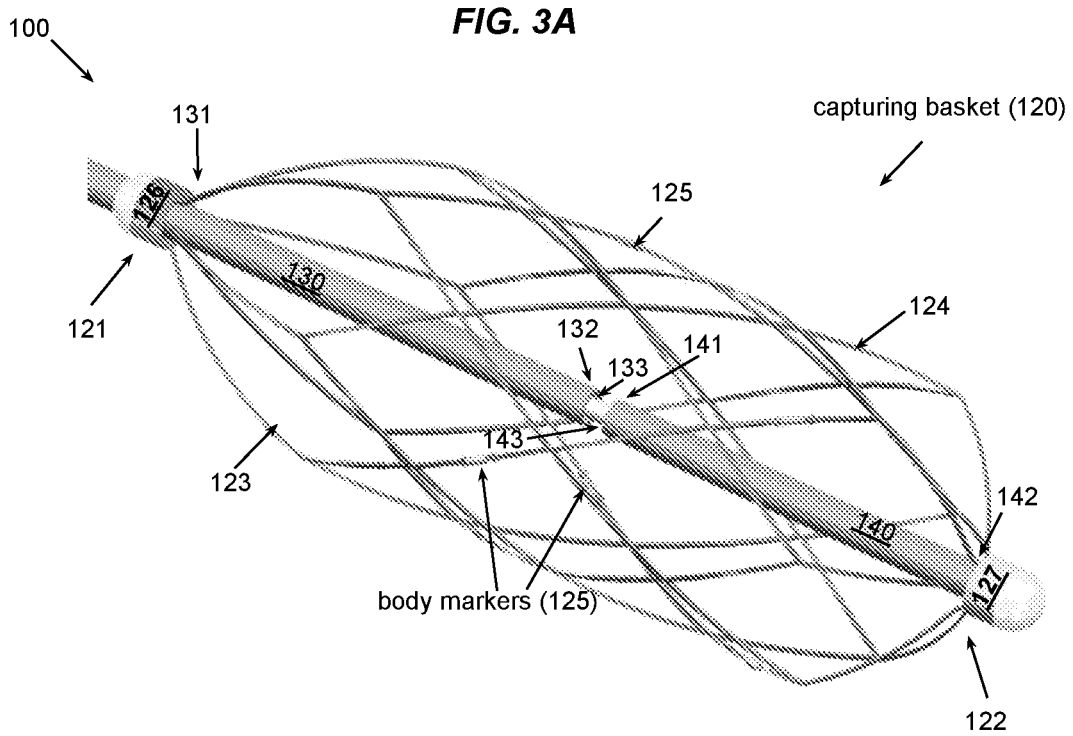
Figure 3B:
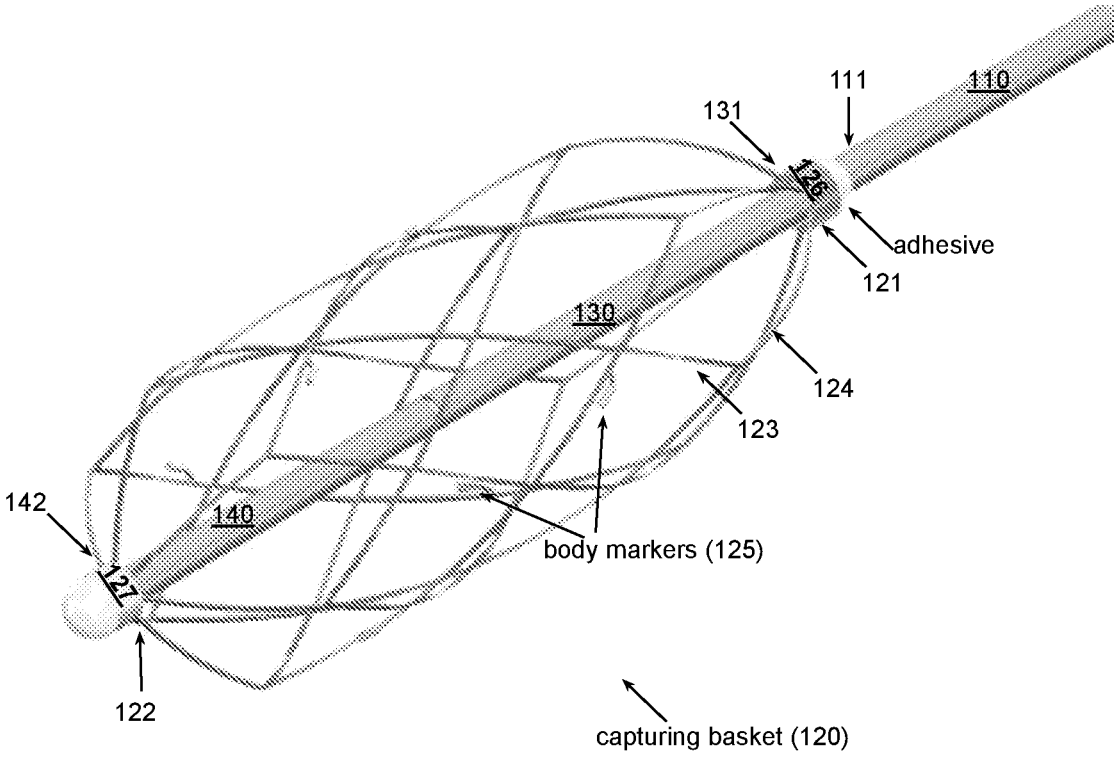
Figure 3B:
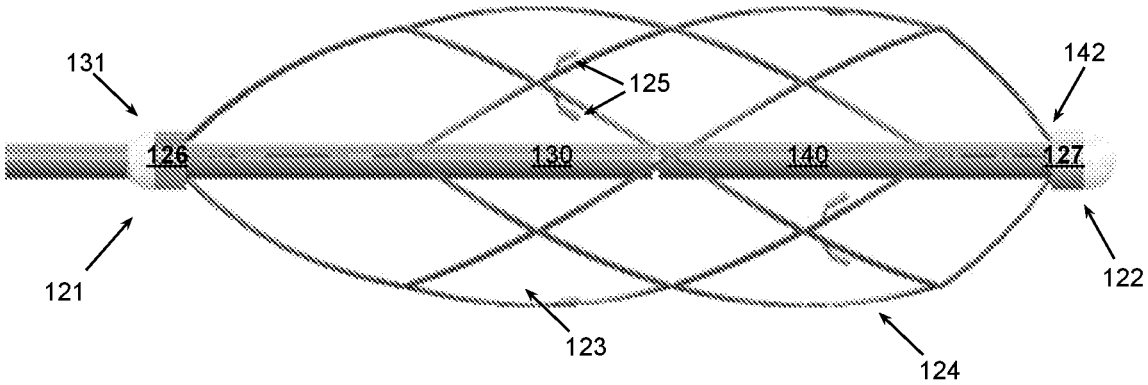

Following is a list of elements corresponding to a particular element referred to herein:

100 Clot Retrieval Device
110 Delivery Shaft
111 Distal Delivery Shaft End
120 Capturing Basket
121 First Basket End
122 Second Basket End
123 Cells
125 Body Markers
126 First Marker
127 Second Marker
150 Support Component
130 First Support Portion
131 First End
132 Second End
133 First Lumen
140 Second Support Portion
141 First End
142 Second End
143 Second Lumen
160 Inner Shaft

170 Delivery Sheath

180 Delivery Catheter

Referring now to FIGS. 1A-12, the present invention features devices and methods for trapping and retrieving an embolus.

The present invention features a capturing basket (120) for capturing an embolus. The capturing basket comprises a first basket end (121) and a second basket end (122). In some embodiments, the capturing basket (120) comprises a plurality of cells (123) defined by struts (124), and at least four body markers (125) disposed on the basket. The struts may have strut ends connected to the first basket end (121) and the second basket end (122).

The present invention may also feature a torquable clot retrieval device (100). The torquable clot retrieval device (100) may comprise a delivery shaft (110; e.g., a pusher) and a capturing basket (120). The delivery shaft (110; e.g., a pusher) has a distal delivery shaft end (111). In some embodiments, the capturing basket (120) is coupled to the distal delivery shaft end (111). The capturing basket (120) comprises a first basket end (121), a second basket end (122), a plurality of cells (123) defined by struts (124), and at least four body markers (125) disposed on the basket (120; e.g., the body markers (125) may be disposed on the struts (124)). The struts (124) may have strut ends that are connected to the first basket end (121) and the second basket end (122). The device (100) is configured such that torque is transferred through the delivery shaft (110) to the capturing basket (120). For example, when the delivery shaft is rotated, torque is transferred from the delivery shaft to the capturing basket, such that the capturing basket is also rotated.

The present invention may further feature a clot retrieval device (100). The clot retrieval device (100) may comprise a delivery shaft (110; e.g., a pusher) and a capturing basket (120). The delivery shaft (110; e.g., a pusher) has a distal delivery shaft end (111). In some embodiments, the capturing basket (120) is coupled to the distal delivery shaft end (111). The capturing basket (120) comprises a first basket end (121), a second basket end (122), a plurality of cells (123) defined by struts (124), and at least four body markers (125) disposed on the basket (120; e.g., the body markers (125) may be disposed on the struts (124)). The struts may have strut ends connected to the first basket end (121) and the second basket end (122).

In some embodiments, the clot retrieval device (100) may comprise a delivery shaft (110; e.g., a pusher), a capturing basket (120), and a support component (150). The delivery shaft (110; e.g., a pusher) has a distal delivery shaft end (111). In some embodiments, the capturing basket (120) is coupled to the distal delivery shaft end (111). The capturing basket (120) comprises a first basket end (121), a second basket end (122), a plurality of cells (123) defined by struts (124), and at least four body markers (125) disposed on the basket (120; e.g., the body markers (125) may be disposed on the struts (124)). The struts (124) may have strut ends that are connected to the first basket end (121) and the second basket end (122). In some embodiments, the support component (150) is coupled to the distal delivery shaft end (111) and disposed within the capturing basket (120).

In some embodiments, the support component (150) comprises a first support portion (130) comprising a first end (131), a second end (132), and a first lumen (133). In some embodiments, the first end (131) of the first support portion (130) is disposed within the basket (120) proximal to the first basket end (121). In some embodiments, the support component (150) comprises a second support portion (140) comprising a first end (141), a second end (142), and a second lumen (143). In some embodiments, the second end (142) of the second support portion (140) is disposed within the basket (120) proximal to the second basket end (122). In some embodiments, the second end (132) of the first support portion (130) is adjacent to the first end (141) of the second support portion (140). In some embodiments, the second end (142) of the second support portion (140) may be fixed to the second basket end (122) of the capturing basket (120). In other embodiments, the support component (150) further comprises an inner shaft (160) disposed through the first lumen (133) of the first support portion (130) and the second lumen (143) of the second support portion (140).

In some embodiments, the inner shaft (160) is movable. In some embodiments, the inner shaft (160) is free-floating and is not affixed to either end (e.g., not affixed to the first end (131) of the first support portion (130) or to the second end (142) of the second support portion (140)). In some embodiments, the inner shaft (160) is free-floating inside the first lumen (133) of the first support portion (130) and the second lumen (143) of the second support portion (140). In other embodiments, the inner shaft (160) is affixed to the second end (142; e.g., the distal end) of the second support portion (140). In further embodiments, the inner shaft (160) is affixed to the first end (131; e.g., the proximal end) of the first support portion (130). In certain embodiments, the inner shaft (160) is affixed to the first end (131; e.g., the proximal end) of the first support portion (130) and affixed to the second end (142; e.g., the distal end) of the second support portion (140).

Figure 6A:
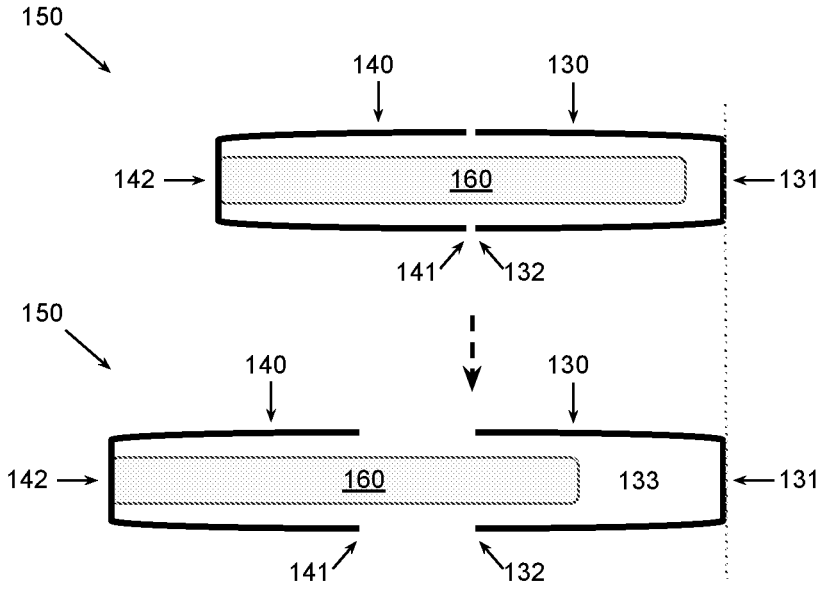

In some embodiments, the clot retrieval devices (100) described herein comprise an inner shaft (160) affixed to the second end (142; e.g., the distal end) of the second support portion (140) (see FIG. 6A). This allows the second support portion (140) to be movable relative to the first support portion (130) and allows for the inner shaft (160) to slide within the first lumen (133) of the first support portion (130). In some embodiments, the first support portion (130) is stationary relative to the delivery shaft (110). In some embodiments, the first end (131) of the first support portion (130) is fixed to the distal delivery shaft end (111) of the delivery shaft (110). When the inner shaft (160) slides distally within the first lumen (133) of the first support portion (130), away from the first end (131) of the support portion (130), the capturing basket (120) elongates (i.e., the second basket end (122) moves away (i.e., distally) from the first basket end (121)). The inner shaft sliding distally within the first lumen (133) of the first support portion (130) causes the second end (142) of the second support portion (140) also to extend distally, away from the first support portion (130). Additionally, when the inner shaft (160) slides proximally within the first lumen (133) of the first support portion (130), towards the first end (131) of the support portion (130), the capturing basket (120) collapses (i.e., the second basket end (122) moves towards (i.e., proximally) the first basket end (121)).

Figure 6B:
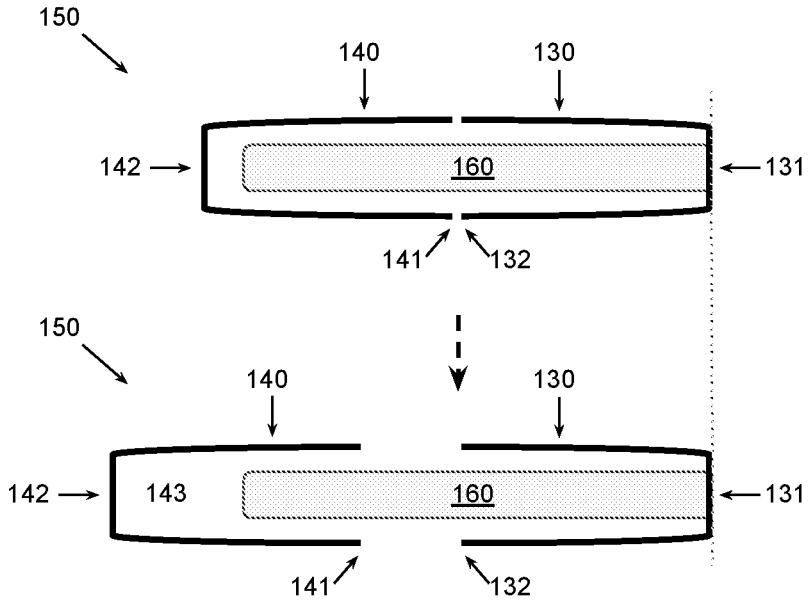

In other embodiments, the clot retrieval devices (100) described herein comprise an inner shaft (160) affixed to the first end (131; e.g., the proximal end) of the first support portion (130) (see FIG. 6B). This allows the second support portion (140) to be movable relative to the first support portion (130) and allows for the second lumen (143) of the second support portion (140) to slide over the inner shaft (160). In some embodiments, the first support portion (130) is stationary relative to the delivery shaft (110). In some embodiments, the first end (131) of the first support portion (130) is fixed to the distal delivery shaft end (111) of the delivery shaft (110). When the second support portion (140) slides distally along the inner shaft (160), away from the first support portion (130), the capturing basket (120) elongates (i.e., the second basket end (122) moves away (i.e., distally) from the first basket end (121)). Additionally, when the second support portion (140) slides proximally along the inner shaft (160) towards the first support portion (130), the capturing basket (120) collapses (i.e., the second basket end (122) moves towards (i.e., proximally) the first basket end (121)).

Figure 6C:
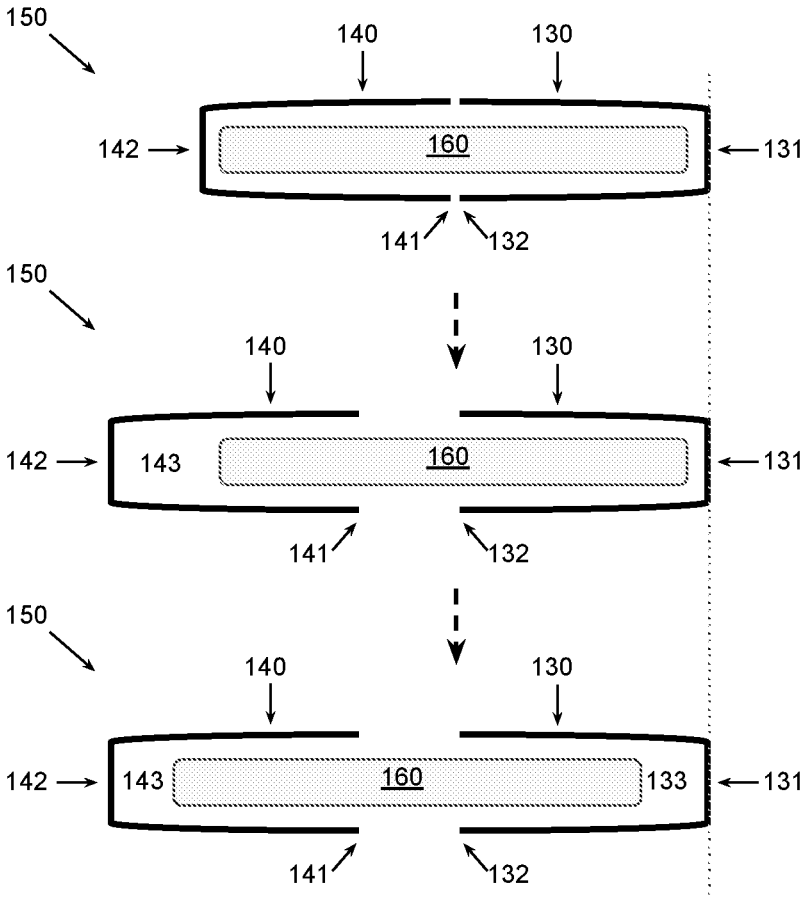

In certain embodiments, the clot retrieval devices (100) described herein comprise an inner shaft (160) that is free-floating and not affixed to either end (i.e., not affixed to the first end (131) of the first support portion (130) or to the second end (142) of the second support portion (140)) (see FIG. 6C). This allows the second support portion (140) to be movable relative to the first support portion (130). In some embodiments, the first support portion (130) is stationary relative to the delivery shaft (110). In some embodiments, the first end (131) of the first support portion (130) is fixed to the distal end (111) of the delivery shaft (110). In some embodiments, the second end (142) of the second support portion (140) is fixed to the second basket end (122) of the capturing basket (120). Using the inner shaft (160) as a guide (e.g., a structure that directs the motion or positioning of something), when the second support portion (140) moves away from the first support portion (130), the capturing basket (120) elongates (i.e., the second basket end (122) moves away (i.e., distally) from the first basket end (121)). Additionally, when the second support portion (140) slides proximally along the inner shaft (160) towards the first support portion (130), the capturing basket (120) collapses (i.e., the second basket end (122) moves towards (i.e., proximally) the first basket end (121)).

Figure 6D:
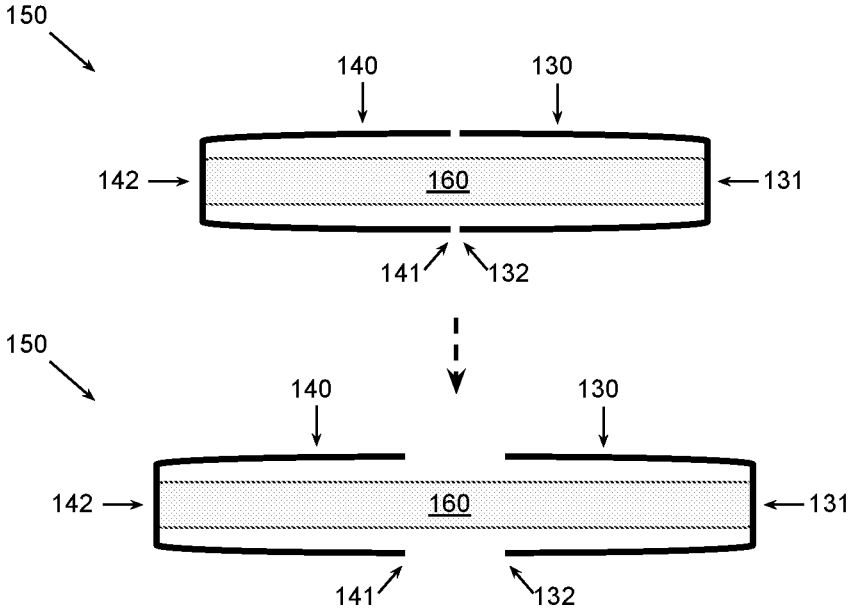
Figure 7:
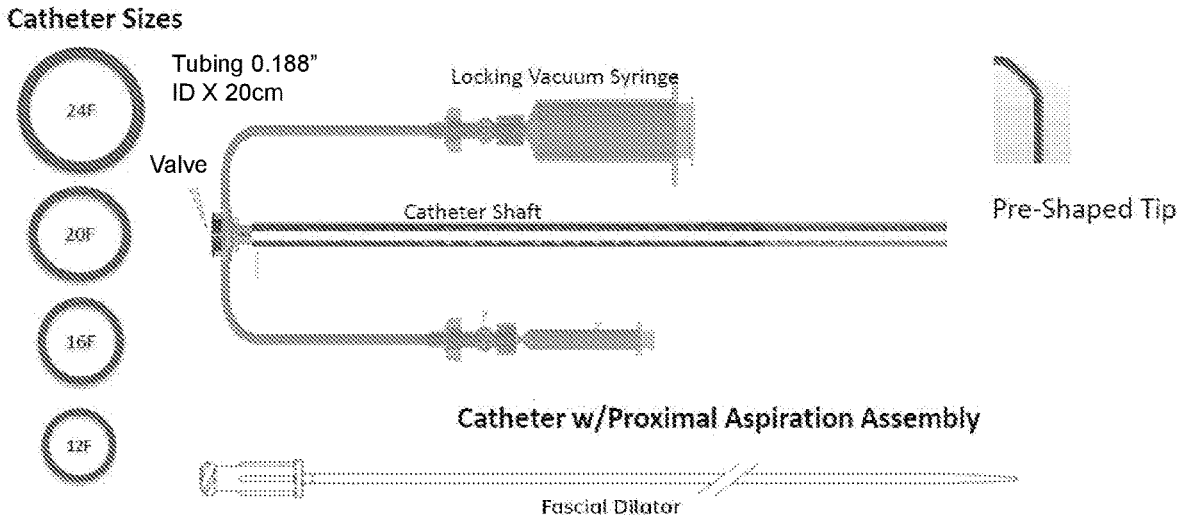
Figure 8:
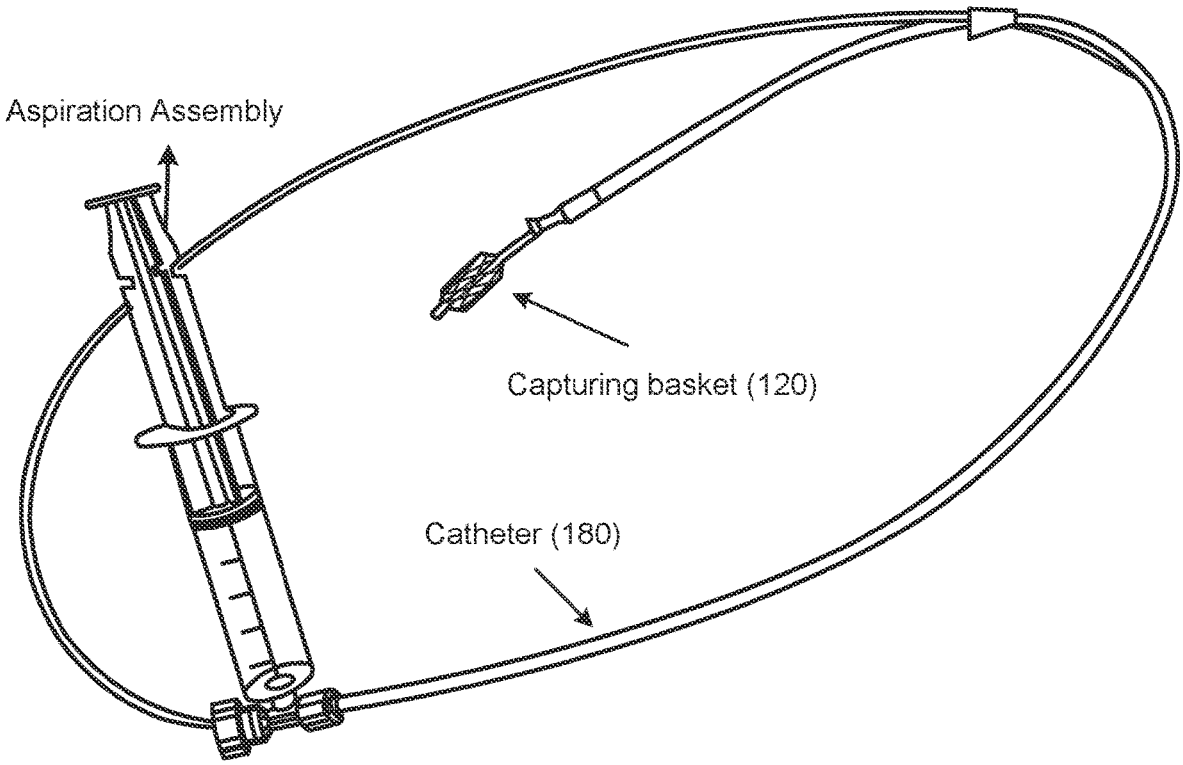
FIG. 8 shows the clot retrieval device assembly, including a delivery catheter.
Figure 9A:
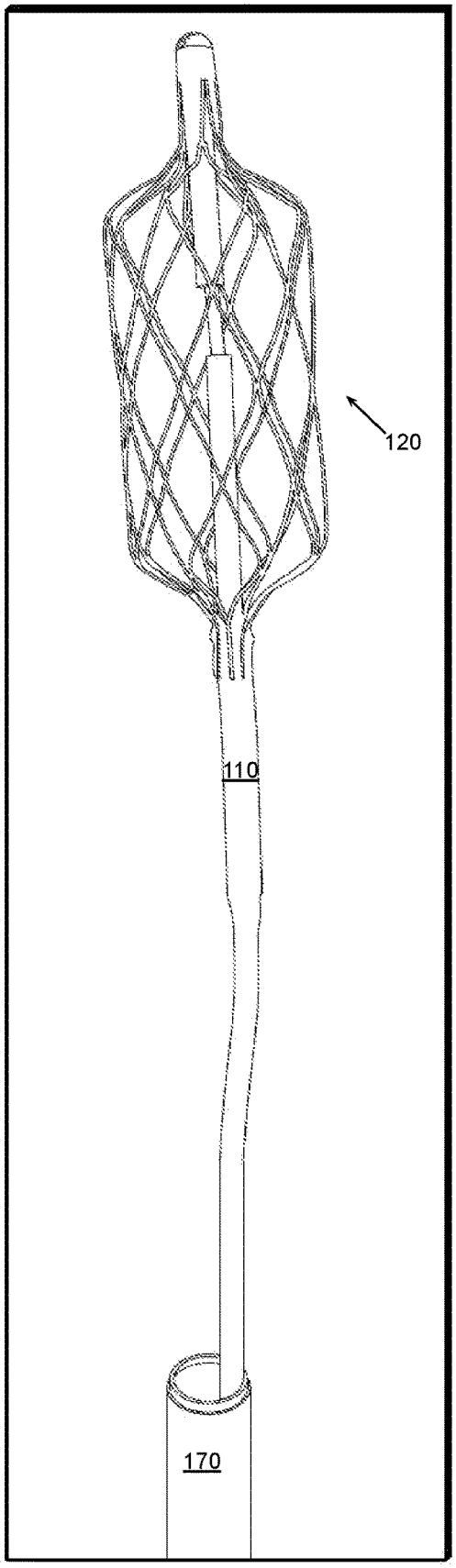
FIGS. 9A and 9B show alternate views of the clot retrieval device, specifically the capturing basket.
Figure 9B:
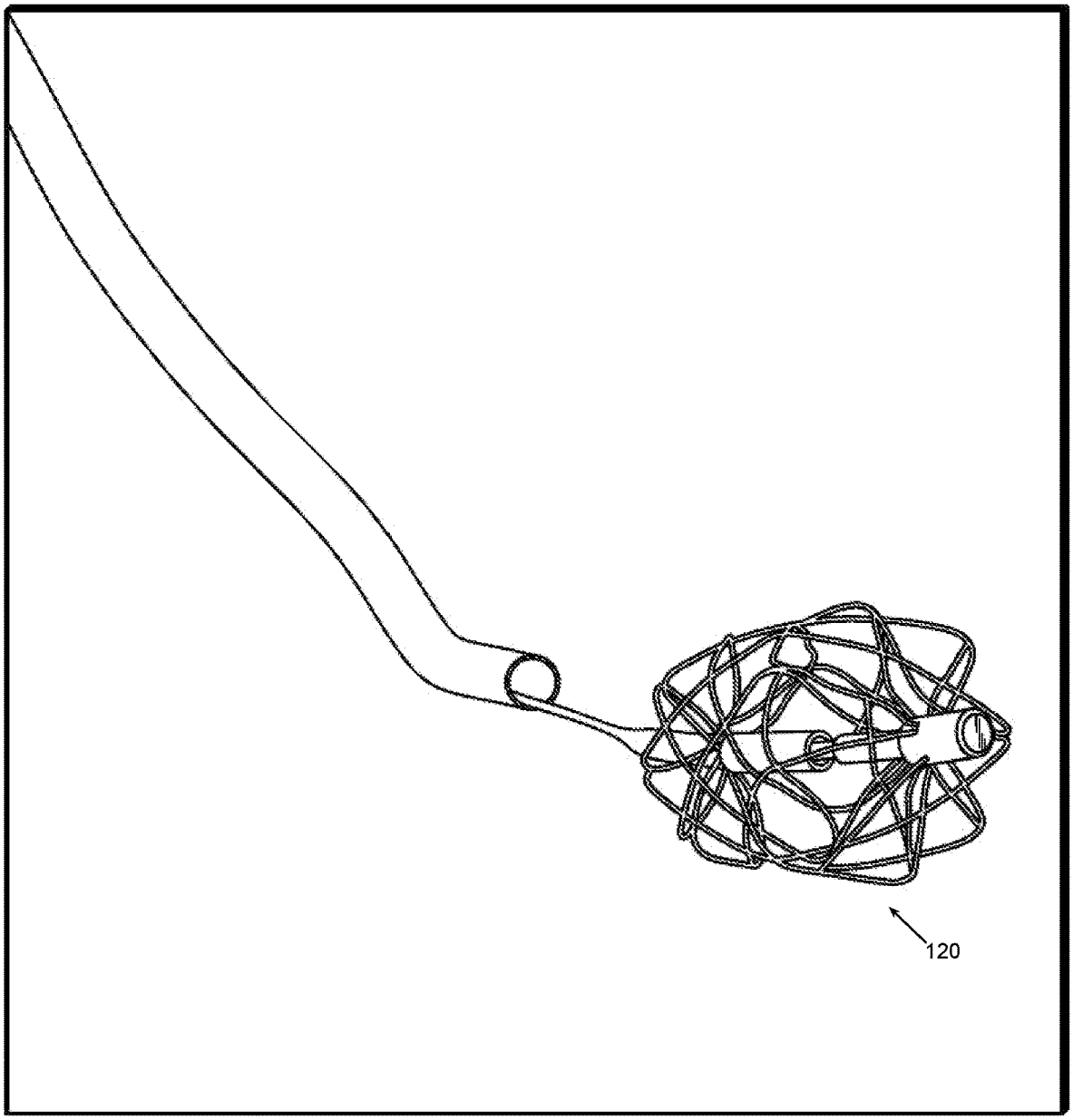
Figure 10:
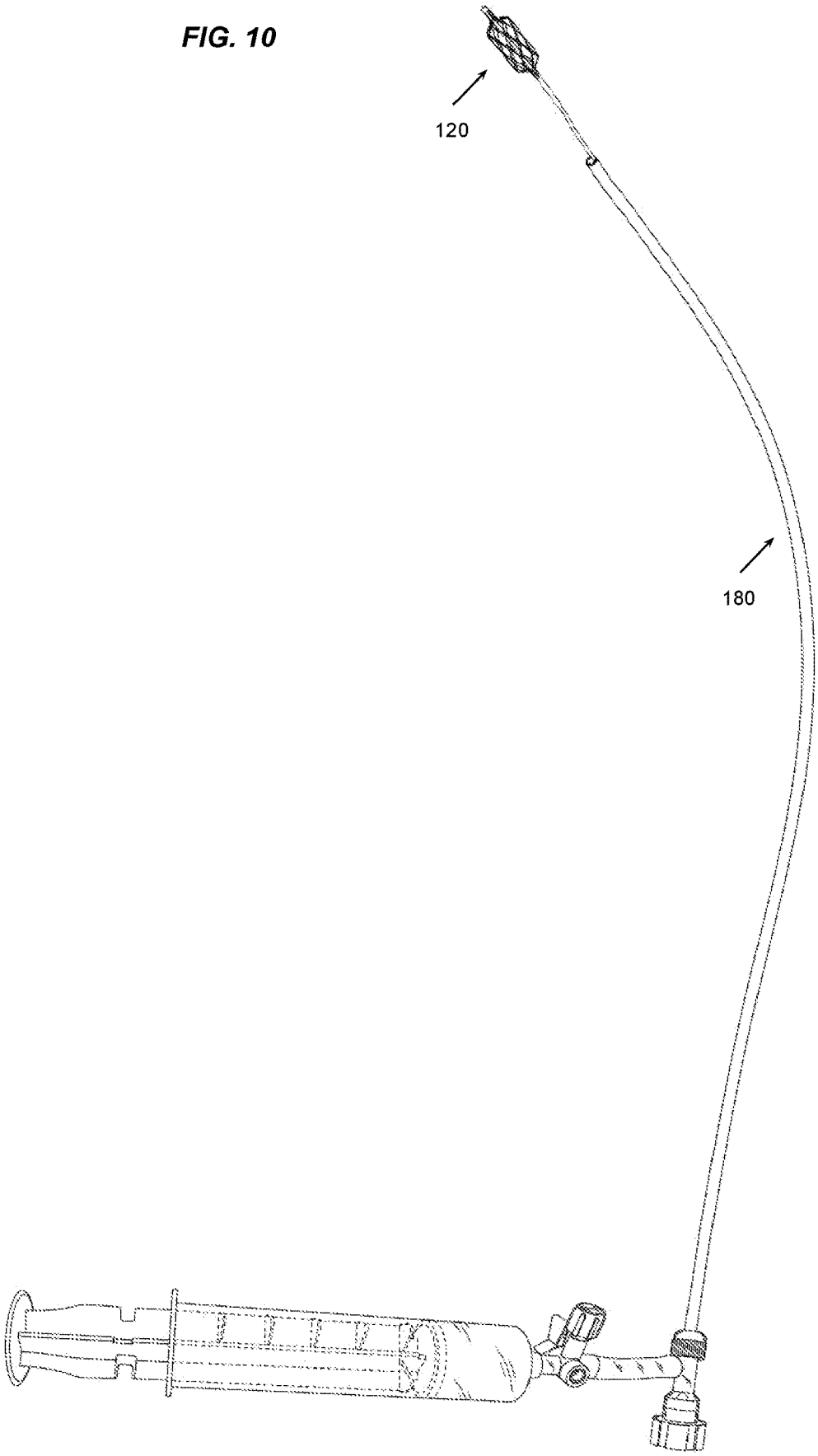
FIG. 10 shows the clot retrieval device comprising a catheter.
Figure 11A:
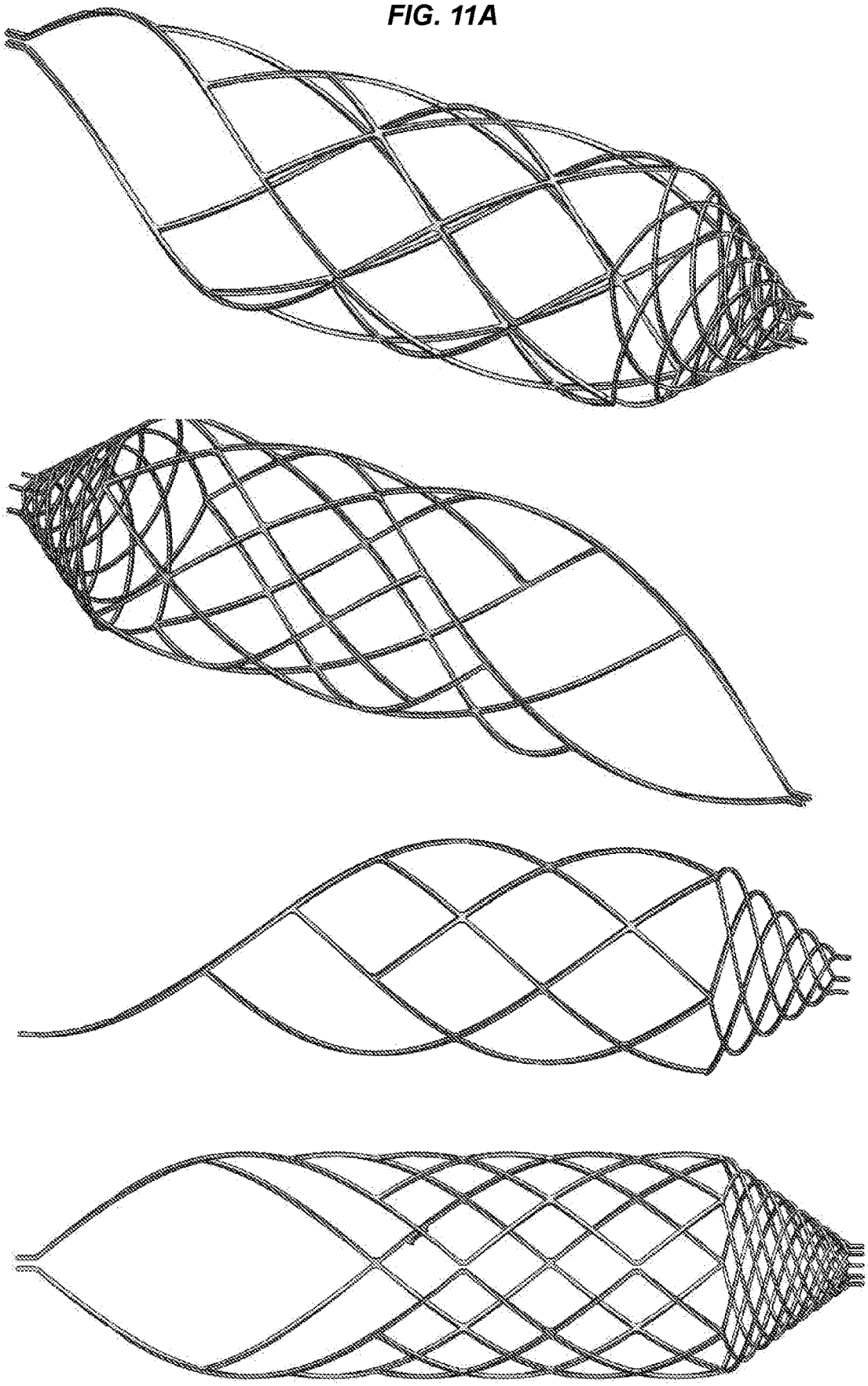
FIGS. 11A and 11B show non-limiting examples of capturing baskets described herein in both 3D (FIG. 11A) and 2D (FIG. 11B).
Figure 11B:
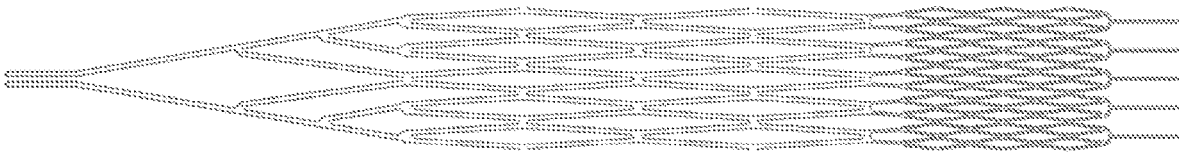
Figure 11B:
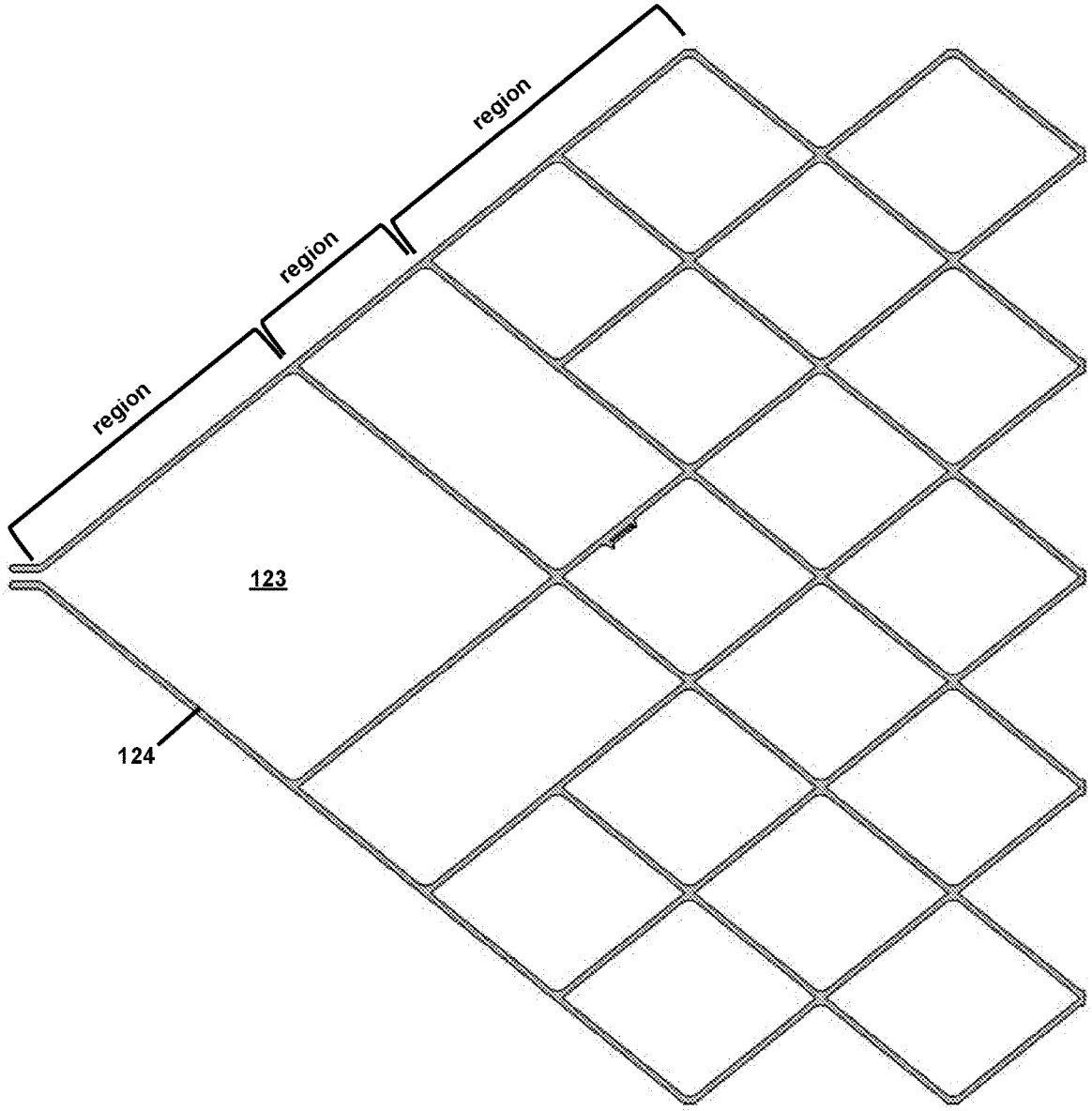
Figure 12:
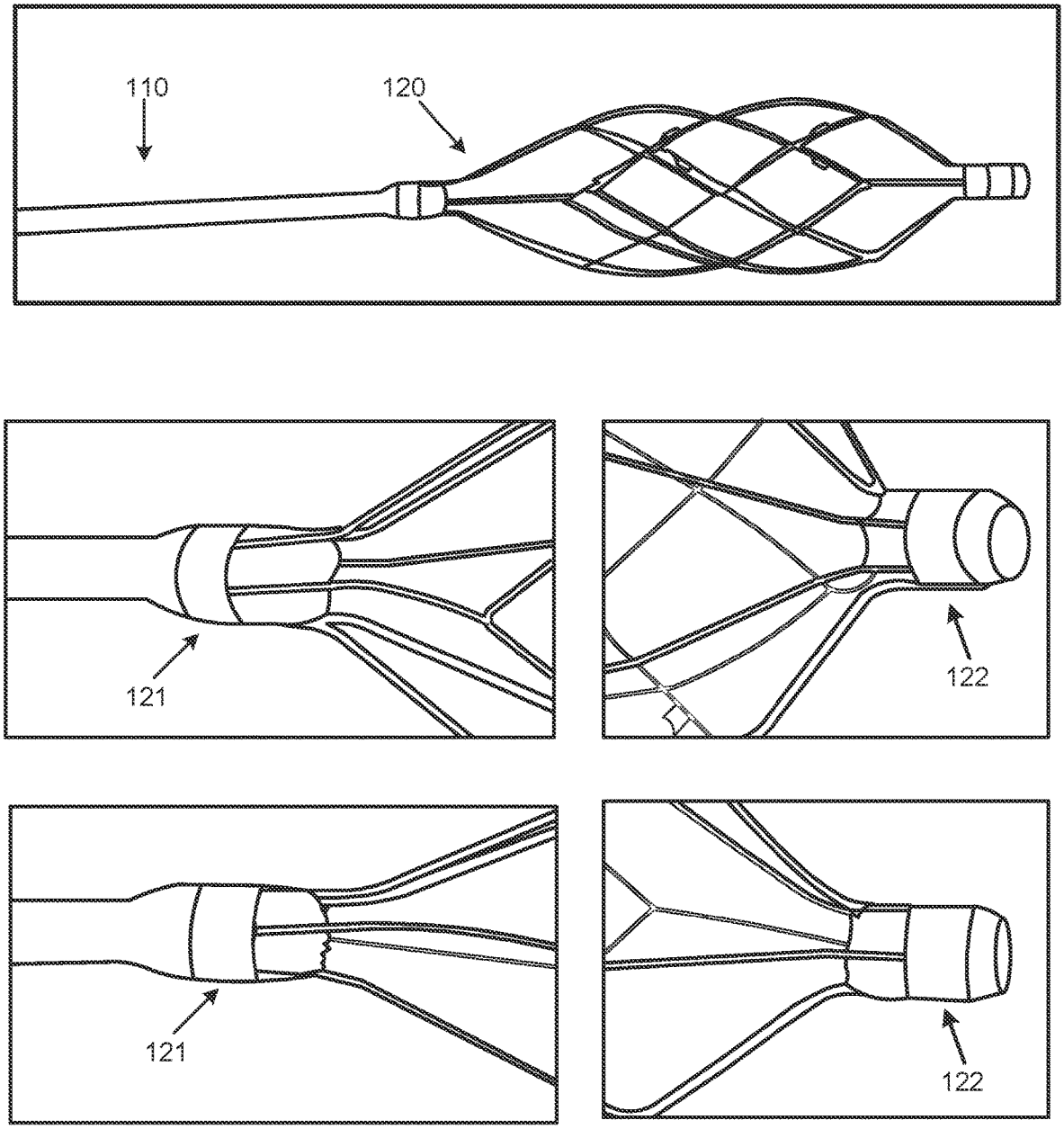
FIG. 12 shows the distal and proximal ends of the capturing basket and how the capturing basket is coupled to the distal end of the delivery shaft.

In further embodiments, the clot retrieval devices (100) described herein comprise an inner shaft (160) affixed to both the first end (131) of the first support portion (130) or to the second end (142) of the second support portion (140)) (see FIG. 6D). In this embodiment, the inner shaft (160) is extendable and may be made from an elastomeric material. When the length of the inner shaft (160) increases (e.g., when the inner shaft (160) is stretched), the second basket end (122) moves away (i.e., distally) from the first basket end (121), thus elongating the capturing basket (120). Additionally, when the length of the inner shaft (160) decreases (e.g., when the inner shaft (160) is contracted (e.g., shortened)), the second basket end (122) moves towards (i.e., proximally) the first basket end (121)) thus collapsing the capturing basket (120).

In certain embodiments, the support component (150) comprises a telescoping shaft. In some embodiments, when the telescoping shaft of the support component (150) is extended, the capturing basket (120) elongates. In some embodiments, when the telescoping shaft of the support component (150) is shortened, the capturing basket (120) collapses.

In some embodiments, the support component (150) has flexibility or elasticity. In some embodiments, the support component (150) is made of a flexible or elastic material. Such flexible or elastic material may include but is not limited to a polyether ether ketone (PEEK) polymer comprising a polytetrafluoroethylene (PTFE) coating. In certain embodiments, the support component (150) comprises material of optimum flexibility, such as PEEK/PTFE composite. Other flexible/elastic materials may be used in accordance with the present invention (e.g., the support component (150)).

In some embodiments, the capturing basket (120) has a length of 30 mm to 50 mm. In other embodiments, the capturing basket (120) has a length of about 20 mm to 60 mm, or about 20 mm to 50 mm, or about 20 mm to 40 mm, or about 20 mm to 30 mm, or about 30 mm to 60 mm, or about 30 mm to 50 mm, or about 30 mm to 40 mm, or about 40 mm to 60 mm, or about 40 mm to 50 mm, or about 50 mm to 60 mm. In further embodiments, the capturing basket (120) has a length of about 20 mm, or about 30 mm, or about 40 mm, or about 50 mm, or about 60 mm. In other embodiments, the capturing basket (120) has a length greater than 60 mm.

In some embodiments, the capturing basket (120) may elongate (e.g., the second basket end (122) moves away (i.e., distally) from the first basket end (121)) or collapse (e.g., the second basket end (122) moves towards (i.e., proximally) the first basket end (121)) by about 20% of the original length of the capturing basket (120). In other embodiments, the capturing basket (120) may elongate or collapse by about 10% of the original length of the capturing basket (120). In further embodiments, the capturing basket (120) may elongate or collapse by about 30% of the original length of the capturing basket (120).

In some embodiments, the capturing basket (120) may elongate or collapse by 5 mm to 10 mm. In other embodiments, the capturing basket (120) may elongate or collapse by about 2 mm to 18 mm, or about 2 mm to 16 mm, or about 2 mm to 14 mm, or about 2 mm to 12 mm, or about 2 mm to 10 mm, or about 2 mm to 8 mm, or about 2 mm to 6 mm or about 2 mm to 4 mm, or about 4 mm to 18 mm, or about 4 mm to 16 mm, or about 4 mm to 14 mm, or about 4 mm to 12 mm, or about 4 mm to 10 mm, or about 4 mm to 8 mm, or about 4 mm to 6 mm or about 6 mm to 18 mm, or about 6 mm to 16 mm, or about 6 mm to 14 mm, or about 6 mm to 12 mm, or about 6 mm to 10 mm, or about 6 mm to 8 mm or about 8 mm to 18 mm, or about 8 mm to 16 mm, or about 8 mm to 14 mm, or about 8 mm to 12 mm, or about 8 mm to 10 mm, or about 10 mm to 18 mm, or about 10 mm to 16 mm, or about 10 mm to 14 mm, or about 10 mm to 12 mm, or about 12 mm to 18 mm, or about 12 mm to 16 mm, or about 12 mm to 14 mm, or about 14 mm to 18 mm, or about 14 mm to 16 mm, or about 16 mm to 18 mm.

In some embodiments, the capturing basket (120) may have an unconstrained (i.e., fully expanded) diameter of 10 mm to 14 mm. In other embodiments, the capturing basket (120) may have an unconstrained (i.e., fully expanded) diameter of about 2 mm to 18 mm, or about 2 mm to 16 mm, or about 2 mm to 14 mm, or about 2 mm to 12 mm, or about 2 mm to 10 mm, or about 2 mm to 8 mm, or about 2 mm to 6 mm, or about 2 mm to 4 mm, or about 4 mm to 18 mm, or about 4 mm to 16 mm, or about 4 mm to 14 mm, or about 4 mm to 12 mm, or about 4 mm to 10 mm, or about 4 mm to 8 mm, or about 4 mm to 6 mm, 6 mm to 18 mm, or about 6 mm to 16 mm, or about 6 mm to 14 mm, or about 6 mm to 12 mm, or about 6 mm to 10 mm, 6 mm to 8 mm, or about 8 mm to 18, or about 8 mm to 16 mm, or about 8 mm to 14 mm, or about 8 mm to 12 mm, or about 8 mm to 10 mm, or about 10 mm to 18, or about 10 mm to 16 mm, or about 10 mm to 14 mm, or about 10 mm to 12 mm, or about 12 mm to 18, or about 12 mm to 16 mm, or about 12 mm to 14 mm, or about 14 mm to 18, or about 14 mm to 16 mm, or about 16 mm to 18 mm. In further embodiments, the capturing basket (120) may have an unconstrained (i.e., fully expanded) diameter of 6 mm, or 8 mm, or 10 mm, or 12 mm, or 14 mm, or 16 mm, or 18 mm.

In some embodiments, the capturing basket (120) has an unconstrained (i.e., fully expanded) diameter that has a constant diameter along the mid-portion of its length. For example, the capturing basket (120) may resemble a cylinder or tube (see FIG. 5). In other embodiments, the capturing basket (120) has an unconstrained (i.e., fully expanded) diameter comprising a continuous taper such that the first basket end (121) has a larger diameter compared to the second basket end (122) (see FIG. 5; e.g., the second basket end (122) has a smaller diameter compared to the first basket end (121)). In further embodiments, the capturing basket (120) has an unconstrained (i.e., fully expanded) diameter comprising a taper at both the first basket end (121) and the second basket end (121) (see FIG. 5) such that the middle portion of the capturing basket (120) has the largest diameter as compared to the first basket end (121) and the second basket end (122). Without wishing to limit the present invention to any theories or mechanisms, it is believed that a smaller diameter at the second basket end (122) enables the capturing basket (120) to enter smaller diameter distal vessels, whereas a larger diameter at the first basket end (121) enables the capturing basket (120) to be effective at proximally larger diameter vessels. In some embodiments, the capturing basket (120) may be able to retrieve clots from two vessels simultaneously, such that the distal vessel is a branch vessel of the proximal vessel.

In some embodiments, the capturing basket (125) may have a constrained (i.e., compressed) diameter of 1.5 mm to 4.0 mm. In other embodiments, the capturing basket (125) may have a constrained (i.e., compressed) of about 1.0 mm to 4.5 mm, or about 1.0 mm to 4.0 mm, or about 1.0 mm to 3.5 mm or about 1.0 mm to 3.0 mm, or about 1.0 mm to 2.5 mm, or about 1.0 mm to 2.0 mm, or about 1.0 mm to 1.5 mm, or about 1.5 mm to 4.5 mm, or about 1.5 mm to 4.0 mm, or about 1.5 mm to 3.5 mm or about 1.5 mm to 3.0 mm, or about 1.5 mm to 2.5 mm, or about 1.5 mm to 2.0 mm, or about 2.0 mm to 4.5 mm, or about 2.0 mm to 4.0 mm, or about 2.0 mm to 3.5 mm or about 2.0 mm to 3.0 mm, or about 2.0 mm to 2.5 mm, or about 2.5 mm to 4.5 mm, or about 2.5 mm to 4.0 mm, or about 2.5 mm to 3.5 mm or about 2.5 mm to 3.0 mm, or about 3.0 mm to 4.5 mm, or about 3.0 mm to 4.0 mm, or about 3.0 mm to 3.5 mm or about 3.5 mm to 4.5 mm, or about 3.5 mm to 4.0 mm, or about 4.0 mm to 4.5 mm.

The capturing basket (120) is loaded in its constrained (i.e., compressed) state into a fixed diameter catheter. In some embodiments, the capturing basket (120) has a constrained (i.e., compressed) diameter that has a constant diameter along the mid-portion of its length (i.e., the constrained (i.e., compressed) diameter is not tapered).

In preferred embodiments, the cells (123) are closed cells. In other embodiments, the cells (123) are opened cells. As used herein, a "closed cell" refers to a fully enclosed cell defined by struts.

The capturing basket (125) may further include cells (123) that decrease in size from a middle portion of the capturing basket (120) towards the first basket end (121) and the second basket end (122). In some embodiments, the cells (123) at the second basket end (122; i.e., the distal end) of the capturing basket (120) are smaller in size than the cells (123) in the middle of the capturing basket (120) and at the first end (121) of the capturing basket (120). In some embodiments, the cells (123) in the middle of the capturing basket (120) are the largest (e.g., when compared to cells (123) at the first end (121) or the second end (122)). In other embodiments, the cells (123) at the first basket end (121; i.e., the proximal end) of the capturing basket (120) are the largest (e.g., when compared to cells (123) in the middle or at the second end (122)). In some embodiments, the cells (123) of the capturing basket (120) are all equal in size.

In some embodiments, the capturing basket (120) comprises cells (123) of a singular size. In other embodiments, the capturing basket (120) comprises cells (123) of varying sizes (see FIGS. 11A and 11B). In some embodiments, the capturing basket comprises cells (123) of one or more varying sizes (e.g., two regions of cells (123) of differing sizes). In some embodiments, the capturing basket comprises cells (123) of two or more varying sizes (e.g., three regions of cells (123) with differing sizes). In some embodiments, the capturing basket comprises cells (123) of three or more varying sizes (e.g., four regions of cells (123) with differing sizes). In some embodiments, the capturing basket comprises cells (123) of four or more varying sizes (e.g., five regions of cells (123) with differing sizes).

Without wishing to limit the present invention to any theory or mechanism, it is believed that the smaller cells (123) at a second basket end (122; i.e., the distal end) of the capturing basket (120) act as a secondary capture "device" for clots that get dislodged from the device or get broken into smaller pieces.

In some embodiments, the cells (123) are quadrilateral in shape. In other embodiments, the cells (123) are irregular quadrilaterals in shape. As used herein, an "irregular quadrilateral" refers to quadrilaterals that are symmetrical but do not require congruent sides or angles. In other embodiments, the cells (123) are rhombus in shape. In some embodiments, the cells (123) are diamond-shaped. As used herein, a "diamond-shaped" and "rhombus" may be used interchangeably and refer to a quadrilateral with four straight, equal sides with both pairs of opposite sides being parallel. In some embodiments, the cells (123) are kite-shaped. As used herein, a "kite-shaped" refers to a quadrilateral whose four sides can be grouped into two pairs of equal-length sides adjacent to each other.

In some embodiments, the cells (123) at the first basket end (121) are kite-shaped. In some embodiments, the cells (123) at the first basket end (121) are kite-shaped in which the longer sides are disposed towards the first basket end (121). Without wishing to limit the present invention to any theory or mechanism, it is believed that kite-shaped cells (123) at the first basket end (121) facilitate the retrieval of the clot retrieval device (100) described herein containing a clot (e.g., the embolus) into a catheter (e.g., an aspiration catheter).

In preferred embodiments, the cells (123) described herein have a height of 4 mm to 8 mm. In some embodiments, the cells (123) have a height of about 2 mm to 10 mm, or about 2 mm to 9 mm, or about 2 mm to 8 mm, or about 2 mm to 7 mm, or about 2 mm to 6 mm, or about 2 mm to 5 mm, or about 2 mm to 4 mm, or about 2 mm to 3 mm, or about 3 mm to 10 mm, or about 3 mm to 9 mm, or about 3 mm to 8 mm, or about 3 mm to 7 mm, or about 3 mm to 6 mm, or about 3 mm to 5 mm, or about 3 mm to 4 mm, or about 4 mm to 10 mm, or about 4 mm to 9 mm, or about 4 mm to 8 mm, or about 4 mm to 7 mm, or about 4 mm to 6 mm, or about 4 mm to 5 mm, or about 5 mm to 10 mm, or about 5 mm to 9 mm, or about 5 mm to 8 mm, or about 5 mm to 7 mm, or about 5 mm to 6 mm, or about 6 mm to 10 mm, or about 6 mm to 9 mm, or about 6 mm to 8 mm, or about 6 mm to 7 mm, or about 7 mm to 10 mm, or about 7 mm to 9 mm, or about 7 mm to 8 mm, or about 8 mm to 10 mm, or about 8 mm to 9 mm, or about 9 mm to 10 mm. In further embodiments, the cells (123) described herein have a height of about 2 mm, or 3 mm, or 4 mm, or 5 mm, or 6 mm, or 7 mm, or 8 mm, or 9 mm, or 10 mm.

In preferred embodiments, the cells (123) described herein have a length of 6 mm to 16 mm. In some embodiments, the cells (123) have a length of about 4 mm to 18 mm, or about 4 mm to 16 mm, or about 4 mm to 14 mm, or about 4 mm to 12 mm, or about 4 mm to 10 mm, or about 4 mm to 8 mm, or about 4 mm to 6 mm, or about 6 mm to 18 mm, or about 6 mm to 16 mm, or about 6 mm to 14 mm, or about 6 mm to 12 mm, or about 6 mm to 10 mm, or about 6 mm to 8 mm, or about 8 mm to 18 mm, or about 8 mm to 16 mm, or about 8 mm to 14 mm, or about 8 mm to 12 mm, or about 8 mm to 10 mm, or about 10 mm to 18 mm, or about 10 mm to 16 mm, or about 10 mm to 14 mm, or about 10 mm to 12 mm, or about 12 mm to 18 mm, or about 12 mm to 16 mm, or about 12 mm to 14 mm, or about 14 mm to 18 mm, or about 14 mm to 16 mm, or about 16 mm to 18 mm. In further embodiments, the cells (123) described herein have a length of about 4 mm, or 6 mm, or 8 mm, or 10 mm, or 12 mm, or 14 mm, or 16 mm, or 18 mm.

In some embodiments, the plurality of cells (123) defined by struts (124) exerts an outward radial force. Generally, a radial force is defined as a force exerted in a radial direction towards the center or away from the center. As used herein, an "outward radial force" may refer to a force exerted outward (i.e., away from the center) by the capturing basket (120) when it is compressed to 50% of its unconstrained diameter.

In preferred embodiments, the outward radial force is 0.10 N/mm length to 0.15 N/mm length. In some embodiments, the outward radial force is about 0.05 N/mm length to 0.20 N/mm length, or about 0.05 N/mm length to 0.18 N/mm length, or about 0.05 N/mm length to 0.16 N/mm length, or about 0.05 N/mm length to 0.15 N/mm length, or about 0.05 N/mm length to 0.14 N/mm length, or about 0.05 N/mm length to 0.12 N/mm length, or about 0.05 N/mm length to 0.10 N/mm length, or about 0.05 N/mm length to 0.08 N/mm length, or about 0.05 N/mm length to 0.06 N/mm length, or about 0.06 N/mm length to 0.20 N/mm length, or about 0.06 N/mm length to 0.18 N/mm length, or about 0.06 N/mm length to 0.16 N/mm length, or about 0.06 N/mm length to 0.15 N/mm length, or about 0.06 N/mm length to 0.14 N/mm length, or about 0.06 N/mm length to 0.12 N/mm length, or about 0.06 N/mm length to 0.10 N/mm length, or about 0.06 N/mm length to 0.08 N/mm length, or about 0.08 N/mm length to 0.20 N/mm length, or about 0.08 N/mm length to 0.18 N/mm length, or about 0.08 N/mm length to 0.16 N/mm length, or about 0.08 N/mm length to 0.15 N/mm length, or about 0.08 N/mm length to 0.14 N/mm length, or about 0.08 N/mm length to 0.12 N/mm length, or about 0.08 N/mm length to 0.10 N/mm length, or about 0.10 N/mm length to 0.20 N/mm length, or about 0.10 N/mm length to 0.18 N/mm length, or about 0.10 N/mm length to 0.16 N/mm length, or about 0.10 N/mm length to 0.15 N/mm length, or about 0.10 N/mm length to 0.14 N/mm length, or about 0.10 N/mm length to 0.12 N/mm length, or about 0.12 N/mm length to 0.20 N/mm length, or about 0.12 N/mm length to 0.18 N/mm length, or about 0.12 N/mm length to 0.16 N/mm length, or about 0.12 N/mm length to 0.15 N/mm length, or about 0.12 N/mm length to 0.14 N/mm length, or about 0.14 N/mm length to 0.20 N/mm length, or about 0.14 N/mm length to 0.18 N/mm length, or about 0.14 N/mm length to 0.16 N/mm length, or about 0.14 N/mm length to 0.15 N/mm length, or about 0.16 N/mm length to 0.20 N/mm length, or about 0.16 N/mm length to 0.18 N/mm length, or about 0.18 N/mm length to 0.20 N/mm length. In further embodiments, the outward radial force is about 0.05 N/mm length, or about 0.06 N/mm length, or about 0.08 N/mm length, or about 0.10 N/mm length, or about 0.12 N/mm length, or about 0.14 N/mm length, or about 0.15 N/mm length, or about 0.16 N/mm length, or about 0.18 N/mm length, or about 0.20 N/mm length.

In some embodiments, the plurality of cells (123) defined by struts allows the embolus to ingress into the capturing basket (120). Without wishing to limit the present invention to any theory or mechanism, it is believed that the shape and dimensions of the plurality of cells (123) defined by struts (124), as well as the width and thickness of said struts (124), allow an embolus to ingress into the capturing basket (120).

In preferred embodiments, the struts (124) have a width of 0.007 to 0.010 in. As used herein, "width" refers to the measurement taken between two lateral sides of the strut (see FIG. 4A; i.e., the measurement taken parallel to the support component (150)). In some embodiments, the struts (124) have a width of about 0.005 in to 0.014 in, or about 0.005 in to 0.013 in, or about 0.005 in to 0.012 in, or about 0.005 in to 0.011 in, or about 0.005 in to 0.010 in, or about 0.005 in to 0.009 in, or about 0.005 in to 0.008 in, or about 0.005 in to 0.007 in, or about 0.005 in to 0.006 in, or about 0.006 in to 0.014 in, or about 0.006 in to 0.013 in, or about 0.006 in to 0.012 in, or about 0.006 in to 0.011 in, or about 0.006 in to 0.010 in, or about 0.006 in to 0.009 in, or about 0.006 in to 0.008 in, or about 0.006 in to 0.007 in, or about 0.007 in to 0.014 in, or about 0.007 in to 0.013 in, or about 0.007 in to 0.012 in, or about 0.007 in to 0.011 in, or about 0.007 in to 0.010 in, or about 0.007 in to 0.009 in, or about 0.007 in to 0.008 in, or about 0.008 in to 0.014 in, or about 0.008 in to 0.013 in, or about 0.008 in to 0.012 in, or about 0.008 in to 0.011 in, or about 0.008 in to 0.010 in, or about 0.008 in to 0.009 in, or about 0.009 in to 0.014 in, or about 0.009 in to 0.013 in, or about 0.009 in to 0.012 in, or about 0.009 in to 0.011 in, or about 0.009 in to 0.010 in, or about 0.010 in to 0.014 in, or about 0.010 in to 0.013 in, or about 0.010 in to 0.012 in, or about 0.010 in to 0.011 in, or about 0.011 in to 0.014 in, or about 0.011 in to 0.013 in, or about 0.011 in to 0.012 in, or about 0.012 in to 0.014 in, or about 0.012 in to 0.013 in, or about 0.013 in to 0.014 in.

In preferred embodiments, the struts (124) have a thickness of 0.007 in to 0.010 in. As used herein, "thickness" refers to the measurement taken from an outer surface of the strut to an inner surface of the strut (see FIG. 4A; i.e., the measurement taken perpendicular to the support component (150)). In some embodiments, the struts (124) have a thickness of about 0.005 in to 0.014 in, or about 0.005 in to 0.013 in, or about 0.005 in to 0.012 in, or about 0.005 in to 0.011 in, or about 0.005 in to 0.010 in, or about 0.005 in to 0.009 in, or about 0.005 in to 0.008 in, or about 0.005 in to 0.007 in, or about 0.005 in to 0.006 in, or about 0.006 in to 0.014 in, or about 0.006 in to 0.013 in, or about 0.006 in to 0.012 in, or about 0.006 in to 0.011 in, or about 0.006 in to 0.010 in, or about 0.006 in to 0.009 in, or about 0.006 in to 0.008 in, or about 0.006 in to 0.007 in, or about 0.007 in to 0.014 in, or about 0.007 in to 0.013 in, or about 0.007 in to 0.012 in, or about 0.007 in to 0.011 in, or about 0.007 in to 0.010 in, or about 0.007 in to 0.009 in, or about 0.007 in to 0.008 in, or about 0.008 in to 0.014 in, or about 0.008 in to 0.013 in, or about 0.008 in to 0.012 in, or about 0.008 in to 0.011 in, or about 0.008 in to 0.010 in, or about 0.008 in to 0.009 in, or about 0.009 in to 0.014 in, or about 0.009 in to 0.013 in, or about 0.009 in to 0.012 in, or about 0.009 in to 0.011 in, or about 0.009 in to 0.010 in, or about 0.010 in to 0.014 in, or about 0.010 in to 0.013 in, or about 0.010 in to 0.012 in, or about 0.010 in to 0.011 in, or about 0.011 in to 0.014 in, or about 0.011 in to 0.013 in, or about 0.011 in to 0.012 in, or about 0.012 in to 0.014 in, or about 0.012 in to 0.013 in, or about 0.013 in to 0.014 in.

In some embodiments, the ratio between the width and thickness of the struts (124) may be at least 1. The width and thickness of the struts may be modified based on the size of the cell they define. For example, for smaller cells (e.g., at the second basket end (122)), the struts may be thinner, and for larger cells (e.g., cells at the first basket end (121)), the struts may be wider and thicker.

The struts (124), as described herein, may comprise surface heterogeneity. As used herein, "surface heterogeneity" refers to small (i.e., less than 0.5 mm) irregularities on a surface that makes said surface rough (i.e., not smooth). In some embodiments, the surface heterogeneity is on the inner surface of the struts (124). In other embodiments, the surface heterogeneity is on a lateral surface of the struts (124). In further embodiments, the surface heterogeneity is on an external surface of the struts (124). In some embodiments, the surface heterogeneity comprises grooves, protrusions, or a combination thereof. In certain embodiments, the protruding surface heterogeneity may be used as body markers (125), in which a radiopaque marker is added to the protrusion. In some embodiments, the surface heterogeneity on a surface of the struts (124) is made by using a laser (e.g., laser cutting) or other means.

Without wishing to limit the present invention to any theories or mechanisms, it is believed that the surface heterogeneity on the struts (124) described herein helps retain an embolus and keeps the embolus trapped (i.e., keeps the embolus retained) in the capturing basket (120). The surface heterogeneity may be prepared using a laser or other means.

The whole capturing basket (120) may be made by laser cutting from a tube and shape-setting to a final shape. In various embodiments, the capturing basket (120) is made by layer deposition using 3D printing. Also, in various embodiments, vapor deposition can be employed to make the capturing basket.

Without wishing to limit the present invention to any theories or mechanisms, it is believed that the use of a laser-cut capturing basket (120) is critical to the present invention because it enables the optimum radial force and cell sizes in the capturing basket (120) which allows for the capturing basket (120) to be able to dislodge clot from a vessel wall as well as to shear the clot before allowing it to ingress into the cell.

In some embodiments, the capturing basket (120) may comprise less metal which allows for more space for a clot to be retrieved, thereby improving retrieval efficiency.

In some embodiments, the capturing basket (120) comprises at least six body markers (125). In other embodiments, the capturing basket (120) comprises at least eight body markers (125). In a further embodiment, the capturing basket (120) comprises at least ten body markers (125). In some embodiments, the capturing basket (120) comprises more than ten body markers (125).

Figure 4A:
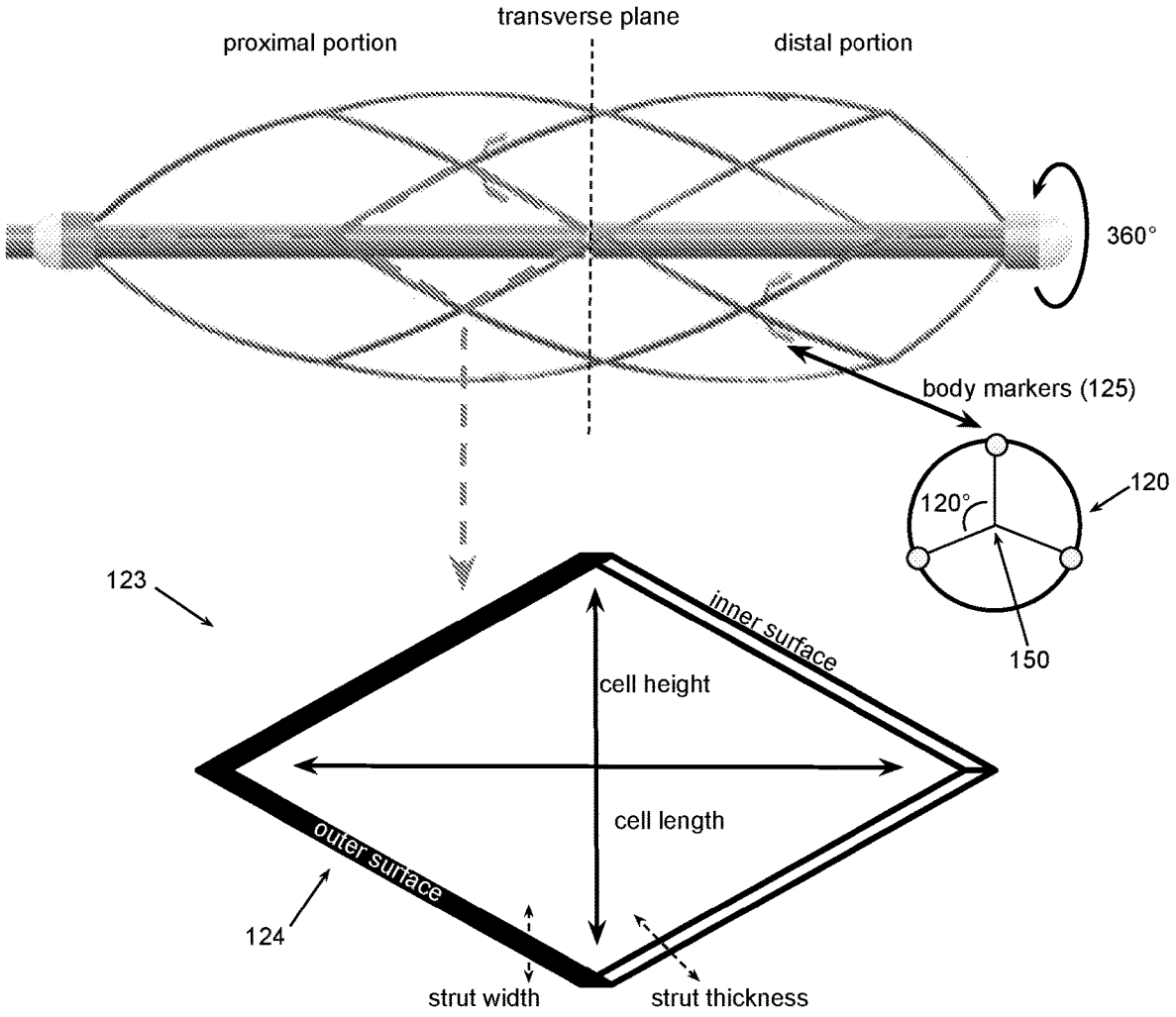
Figure 4B:
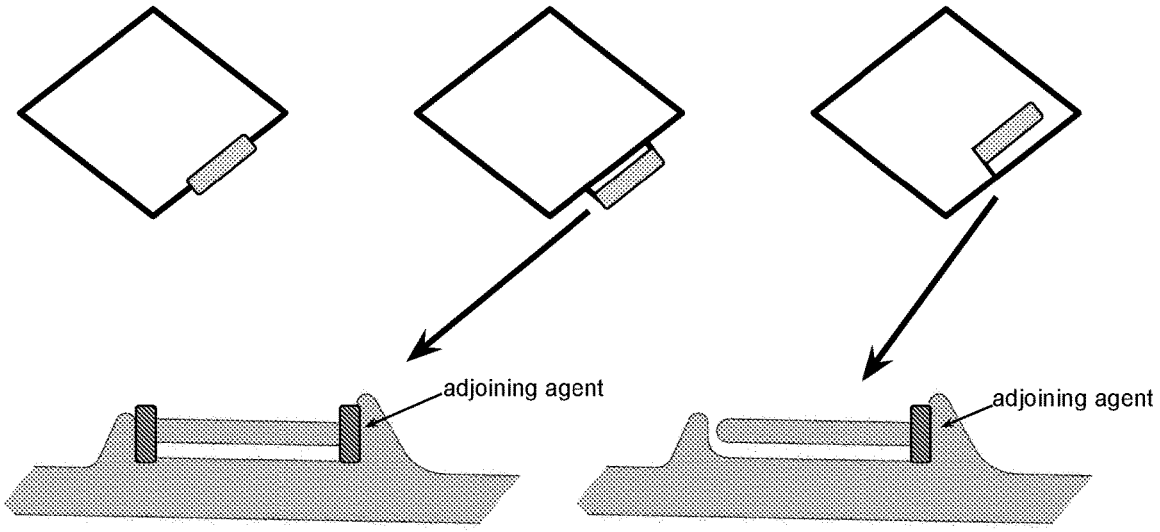
Figure 4C:
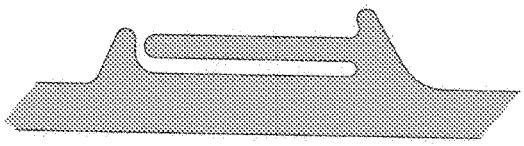
Figure 5:
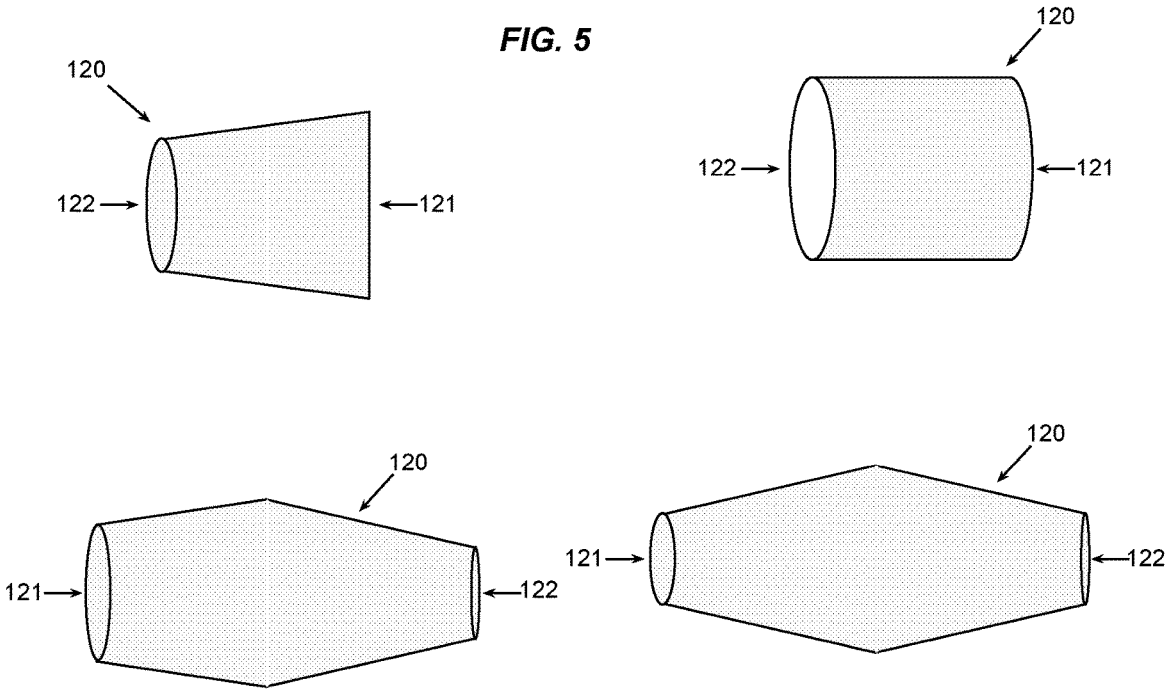

The capturing basket (120) may be divided along a transverse plane (e.g., divided perpendicular to the support structure (150); see FIG. 4A). Dividing the capturing basket (120) along a transverse plane creates two portions (e.g., a distal portion and a proximal portion). In some embodiments, the body markers (125) are distributed equally between the two portions (e.g., a distal portion and a proximal portion) of the capturing basket (120) created by the transverse plane.

In some embodiments, the body markers (125) described herein are distributed equiangularly around the capturing basket (120). In some embodiments, the body markers (125) described herein are distributed equiangularly around the capturing basket (120) within a single portion (e.g., the distal portion or the proximal portion). In some embodiments, the body markers (125) within a single portion (e.g., the distal portion or the proximal portion) of the capturing basket are 120° apart from each other.

The body markers (125) as described herein are disposed on the struts (124) of the capturing basket (120). In some embodiments, the body markers (125) are aligned with the struts (124) of the capturing basket (120) (see FIG. 4B, left). In other embodiments, the body markers (125) are parallel with the struts (124) of the capturing basket (120) (see FIG. 4B, middle/right). In other embodiments, the body markers (125) protrude from the struts (124) of the capturing basket (120) (see FIG. 4B, middle/right). In some embodiments, the body markers (125) are attached to the struts (124) at a single attachment point (e.g., a single protrusion on the struts (124); (FIG. 4B, right)). In some embodiments, the body markers (125) are attached to the struts (124) at two attachment points (e.g., two protrusions on the struts (124); (FIG. 4B, middle)). In some embodiments, the body markers (125) are attached to the struts (124) at one or more or two or more attachment points (e.g., protrusions) on the struts (124). In other embodiments, the body makers (125) are attached to the struts (124) continuously as one continuous attachment (e.g., the body marker is joined along its full length as a continuous joint).

The protrusions may serve as a cushion (e.g., pillows) for the body markers (125), provide additional support and/or structural integrity to the body markers (125), allow for proper positioning of the body markers (125) on the struts (124), help maintain appropriate positioning of the body markers (125), and/or help maintain structural integrity of the body markers (125), etc. In some embodiments, the distal protrusion may be shorter (e.g., smaller) than the proximal protrusion (i.e., the proximal protrusion is taller (e.g., larger) than the distal protrusion) (See FIG. 4C). The present invention is not limited to the configurations shown or described herein.

In some embodiments, the body markers (125) are radiopaque markers. In some embodiments, the radiopaque markers comprise tantalum, platinum, or other radiopaque materials.

In some embodiments, the body markers (125) described herein are attached to the struts (124) with an adjoining agent. Adjoining agents that may be used to attach a body marker (125) to a strut (124) include but are not limited to adhesives, soldering, or welding.

Without wishing to limit the present invention to any theories or mechanisms, it is believed that the body markers described herein allow for visualization to be used as an aide to see when the clot is captured or lost and for enhanced clot retention during retrieval.

In some embodiments, the capturing basket (120) is configured to rotate. In some embodiments, the capturing basket (120) is configured to rotate axially. In some embodiments, the capturing basket (120) may be rotated bidirectionally. In some embodiments, the capturing basket (120) rotates at low revolutions per minute (rpm). The capturing basket may rotate at about 2 rpm to 50 rpm, or about 2 rpm to 40 rpm, or about 2 rpm to 30 rpm, or about 2 rpm to 25 rpm, or about 2 rpm to 20 rpm, or about 2 rpm to 15 rpm, or about 2 rpm to 10 rpm, or about 2 rpm to 8 rpm, or about 2 rpm to 6 rpm, or about 2 rpm to 4 rpm, or about 4 rpm to 50 rpm, or about 4 rpm to 40 rpm, or about 4 rpm to 30 rpm, or about 4 rpm to 25 rpm, or about 4 rpm to 20 rpm, or about 4 rpm to 15 rpm, or about 4 rpm to 10 rpm, or about 4 rpm to 6 rpm, or about 6 rpm to 50 rpm, or about 6 rpm to 40 rpm, or about 6 rpm to 30 rpm, or about 6 rpm to 25 rpm, or about 6 rpm to 20 rpm, or about 6 rpm to 15 rpm, or about 6 rpm to 10 rpm, or about 6 rpm to 8 rpm, or about 8 rpm to 50 rpm, or about 8 rpm to 40 rpm, or about 8 rpm to 30 rpm, or about 8 rpm to 25 rpm, or about 8 rpm to 20 rpm, or about 8 rpm to 15 rpm, or about 8 rpm to 10 rpm, or about 10 rpm to 50 rpm, or about 10 rpm to 40 rpm, or about 10 rpm to 30 rpm, or about 10 rpm to 25 rpm, or about 10 rpm to 20 rpm, or about 10 rpm to 15 rpm, or about 15 rpm to 50 rpm, or about 15 rpm to 40 rpm, or about 15 rpm to 30 rpm, or about 15 rpm to 25 rpm, or about 15 rpm to 20 rpm, or about 20 rpm to 50 rpm, or about 20 rpm to 40 rpm, or about 20 rpm to 30 rpm, or about 20 rpm to 25 rpm, or about 25 rpm to 50 rpm, or about 25 rpm to 40 rpm, or about 25 rpm to 30 rpm, or about 30 rpm to 50 rpm, or about 30 rpm to 40 rpm, or about 40 rpm to 50 rpm.

In order to remove large clots, it can sometimes be helpful to shear them into smaller pieces without causing uncontrolled embolic debris (e.g., debris that is dislodged and travels to undesirable locations). Without wishing to limit the present invention to any theories or mechanisms, it is believed that rotating the capturing basket enables controlled shearing of the embolus and also helps dislodge the embolus from the vessel wall. As used herein, "controlled shearing" may refer to slicing (e.g., circumferentially slicing) an object (e.g., a clot) into chunks and does not refer to macerating or pulverizing (i.e., reducing to fine particles by crushing or grinding) an object (e.g., a clot).

The capturing basket (120) may be attached to a delivery shaft (i.e., the pusher or a push-wire; 110), which is a wire that delivers the capturing basket (120) through a vasculature to the location of an embolus and pushes the capturing basket (120) to the side of an embolus via a catheter.

In certain embodiments, the delivery shaft (i.e., the pusher; 110) is braided. In preferred embodiments, the delivery shaft (i.e., the pusher; 110) is hollow. In some embodiments, the delivery shaft (i.e., the pusher; 110) is hollow for at least a section of said shaft. In other embodiments, the delivery shaft (i.e., the pusher; 110) is hollow for the entire length of the delivery shaft (110). In further embodiments, the delivery shaft (i.e., the pusher; 110) comprises a hollow distal end. In certain embodiments, the delivery shaft (i.e., the pusher; 110) is solid.

In some embodiments, a guidewire may be passed through the delivery shaft (110). In some embodiments, a guidewire may be passed through the first basket end (121) and the second basket end (122), such that the guidewire is disposed within the capturing basket. In other embodiments, the device is configured such that a guidewire can pass through the delivery shaft (110) through the second basket end (122), such that the guidewire is disposed within the capturing basket (120).

The delivery shaft (i.e., the pusher; 110) may be rotated. In some embodiments, the delivery shaft (i.e., the pusher; 110) may be axially-rotated. In other embodiments, the delivery shaft (i.e., the pusher; 110) may be hand-rotated. In some embodiments, the delivery shaft (i.e., the pusher; 110) is able to be rotated bidirectionally. In some embodiments, the delivery shaft (i.e., the pusher; 110) is able to withstand torque. In some embodiments, the delivery shaft (i.e., the pusher; 110) allows for torque transfer. In some embodiments, the delivery shaft (i.e., the pusher; 110) allows for a 1:1 torque transfer. For example, when a proximal end of the delivery shaft (i.e., the pusher; 110; e.g, the end opposite the distal end (111) of the delivery shaft (110)) is rotated (e.g., hand-rotated), the equivalent torque is transferred through the delivery shaft (i.e., the pusher; 110) to the capturing basket (120), such that the capturing basket (120) is also rotated. In some embodiments, when the delivery shaft (110) is rotated, torque is transferred from the delivery shaft (110) to the capturing basket (120), such that the capturing basket (120) is also rotated.

In certain embodiments, the delivery shaft (i.e., the pusher; 110) is able to withstand low revolutions per minute (rpm). In certain embodiments, the delivery shaft (i.e., the pusher; 110) is able to withstand revolutions per minute (rpm) of about 2 to 10 rpm. In other embodiments, the delivery shaft (i.e., the pusher; 110) is able to withstand rotations per minute (rpm) of about 2 rpm to 50 rpm, or about 2 rpm to 40 rpm, or about 2 rpm to 30 rpm, or about 2 rpm to 25 rpm, or about 2 rpm to 20 rpm, or about 2 rpm to 15 rpm, or about 2 rpm to 10 rpm, or about 2 rpm to 8 rpm, or about 2 rpm to 6 rpm, or about 2 rpm to 4 rpm, or about 4 rpm to 50 rpm, or about 4 rpm to 40 rpm, or about 4 rpm to 30 rpm, or about 4 rpm to 25 rpm, or about 4 rpm to 20 rpm, or about 4 rpm to 15 rpm, or about 4 rpm to 10 rpm, or about 4 rpm to 6 rpm, or about 6 rpm to 50 rpm, or about 6 rpm to 40 rpm, or about 6 rpm to 30 rpm, or about 6 rpm to 25 rpm, or about 6 rpm to 20 rpm, or about 6 rpm to 15 rpm, or about 6 rpm to 10 rpm, or about 6 rpm to 8 rpm, or about 8 rpm to 50 rpm, or about 8 rpm to 40 rpm, or about 8 rpm to 30 rpm, or about 8 rpm to 25 rpm, or about 8 rpm to 20 rpm, or about 8 rpm to 15 rpm, or about 8 rpm to 10 rpm, or about 10 rpm to 50 rpm, or about 10 rpm to 40 rpm, or about 10 rpm to 30 rpm, or about 10 rpm to 25 rpm, or about 10 rpm to 20 rpm, or about 10 rpm to 15 rpm, or about 15 rpm to 50 rpm, or about 15 rpm to 40 rpm, or about 15 rpm to 30 rpm, or about 15 rpm to 25 rpm, or about 15 rpm to 20 rpm, or about 20 rpm to 50 rpm, or about 20 rpm to 40 rpm, or about 20 rpm to 30 rpm, or about 20 rpm to 25 rpm, or about 25 rpm to 50 rpm, or about 25 rpm to 40 rpm, or about 25 rpm to 30 rpm, or about 30 rpm to 50 rpm, or about 30 rpm to 40 rpm, or about 40 rpm to 50 rpm.

In some embodiments, the devices described herein further comprise a first marker (126) and a second marker (127). In some embodiments, the first marker (126) is disposed at the first basket end (121), and the second marker (127) is disposed at the second basket end (122). In certain embodiments, the first marker (126) and the second maker (127) are radiopaque markers. The radiopaque markers may be positioned to reveal the clot under fluoroscopy. In some embodiments, the radiopaque markers comprise tantalum, platinum, or other radiopaque materials.

For enhanced radiopacity and visualization, radiopaque markers made of tantalum, platinum, or other radiopaque materials may be installed into various portions of the capturing basket.

In some embodiments, the radiopaque markers described herein may be textured to impart additional embolus retention. The textured radiopaque markers may be located in multiple radial directions around the capturing basket (120) to retain dislodged pieces of an embolus in any portion of the capturing basket.

In some embodiments, the device is rotatable. In other embodiments, the device is configured to rotate. For example, when a proximal end of the delivery shaft (i.e., the pusher; 110; e.g., the end opposite the distal end (111) of the delivery shaft (110)) is rotated, torque is transferred through the delivery shaft (110) to the capturing basket (120), such that the capturing basket (120) is also rotated. In some embodiments, the device is axially rotated. In some embodiments, the device is hand-rotated. In some embodiments, the device may be rotated bidirectionally.

In certain embodiments, the device (100) is able to withstand low revolutions per minute (rpm). In certain embodiments, the device (100) is able to withstand rotations per minute (rpm) of about 2 to 10 rpm. In other embodiments, the device (100) is able to withstand rotations per minute (rpm) of about 2 rpm to 50 rpm, or about 2 rpm to 40 rpm, or about 2 rpm to 30 rpm, or about 2 rpm to 25 rpm, or about 2 rpm to 20 rpm, or about 2 rpm to 15 rpm, or about 2 rpm to 10 rpm, or about 2 rpm to 8 rpm, or about 2 rpm to 6 rpm, or about 2 rpm to 4 rpm, or about 4 rpm to 50 rpm, or about 4 rpm to 40 rpm, or about 4 rpm to 30 rpm, or about 4 rpm to 25 rpm, or about 4 rpm to 20 rpm, or about 4 rpm to 15 rpm, or about 4 rpm to 10 rpm, or about 4 rpm to 6 rpm, or about 6 rpm to 50 rpm, or about 6 rpm to 40 rpm, or about 6 rpm to 30 rpm, or about 6 rpm to 25 rpm, or about 6 rpm to 20 rpm, or about 6 rpm to 15 rpm, or about 6 rpm to 10 rpm, or about 6 rpm to 8 rpm, or about 8 rpm to 50 rpm, or about 8 rpm to 40 rpm, or about 8 rpm to 30 rpm, or about 8 rpm to 25 rpm, or about 8 rpm to 20 rpm, or about 8 rpm to 15 rpm, or about 8 rpm to 10 rpm, or about 10 rpm to 50 rpm, or about 10 rpm to 40 rpm, or about 10 rpm to 30 rpm, or about 10 rpm to 25 rpm, or about 10 rpm to 20 rpm, or about 10 rpm to 15 rpm, or about 15 rpm to 50 rpm, or about 15 rpm to 40 rpm, or about 15 rpm to 30 rpm, or about 15 rpm to 25 rpm, or about 15 rpm to 20 rpm, or about 20 rpm to 50 rpm, or about 20 rpm to 40 rpm, or about 20 rpm to 30 rpm, or about 20 rpm to 25 rpm, or about 25 rpm to 50 rpm, or about 25 rpm to 40 rpm, or about 25 rpm to 30 rpm, or about 30 rpm to 50 rpm, or about 30 rpm to 40 rpm, or about 40 rpm to 50 rpm.

As used herein, "low rpms" may refer to a speed that prevents tachycardia and hemolysis of red blood cells. Without wishing to limit the present invention to any theories or mechanisms, it is believed that rotating the device at low rpms prevents red blood cells (RBC) from being hemolyzed and also prevents tachycardia. Both of which may occur when using a high rpm device.

In some embodiments, the devices described herein further comprise a delivery sheath (170). In some embodiments, the clot retrieval device (100) is loaded into the delivery sheath (170) before delivery. In some embodiments, the delivery sheath (170) comprising the clot retrieval device (100) is pushed through a catheter (180; e.g., an aspiration catheter) to reach a target location (i.e., a target lesion; e.g., a clot). In some embodiments, the devices described herein further comprise a delivery catheter (180).

The devices described herein may further comprise a catheter (e.g., an aspiration catheter). Aspiration at a proximal end of the catheter, while the clot retrieval device (100) comprising a clot is being pulled into the catheter and out of the body, may increase the efficiency of clot retrieval. Aspiration can be accomplished manually or using a pump. The devices (100) described herein may operate with or without aspiration assistance In some embodiments, the delivery catheter (180) is an aspiration catheter. In some embodiments, the delivery catheter (180; e.g., the aspiration catheter) comprises a 24 Fr catheter, a 20 Fr catheter, a 16 Fr catheter, or a 12 Fr catheter. In other embodiments, the delivery catheter (180; e.g., the aspiration catheter) comprises a catheter of about 10 Fr to 26 Fr, or about 10 Fr to 24 Fr, or about 10 Fr to 22 Fr, or about 10 Fr to 20 Fr, or about 10 Fr to 18 Fr, or about 10 Fr to 16 Fr, or about 10 Fr to 14 Fr, or about 10 Fr to 12 Fr, or about 12 Fr to 26 Fr, or about 12 Fr to 24 Fr, or about 12 Fr to 22 Fr, or about 12 Fr to 20 Fr, or about 12 Fr to 18 Fr, or about 12 Fr to 16 Fr, or about 12 Fr to 14 Fr, or about 14 Fr to 26 Fr, or about 14 Fr to 24 Fr, or about 14 Fr to 22 Fr, or about 14 Fr to 20 Fr, or about 14 Fr to 18 Fr, or about 14 Fr to 16 Fr, or about 16 Fr to 26 Fr, or about 16 Fr to 24 Fr, or about 16 Fr to 22 Fr, or about 16 Fr to 20 Fr, or about 16 Fr to 18 Fr, or about 18 Fr to 26 Fr, or about 18 Fr to 24 Fr, or about 18 Fr to 22 Fr, or about 18 Fr to 20 Fr, or about 20 Fr to 26 Fr, or about 20 Fr to 24 Fr, or about 20 Fr to 22 Fr, or about 22 Fr to 26 Fr, or about 22 Fr to 24 Fr, or about 24 Fr to 26 Fr.

In some embodiments, the delivery catheter (180; e.g., the aspiration catheter) comprises an attached hub sub-assembly. In some embodiments, the delivery catheter (180; e.g., the aspiration catheter) comprises a valve. In some embodiments, the large size engineered valve in the proximal hub allows for high aspiration efficiency. For example, the valve enables the clot to be aspirated through a side port, while a main port can be opened and closed to the desired opening diameter with the help of a rotating valve. The rotating valve may withstand aspiration forces and remain sealed around any device (e.g., the clot retrieval device (100)) inserted through it to enable aspiration through the side port.

In some embodiments, the delivery catheter (180; e.g., the aspiration catheter) comprises a syringe. In some embodiments, the syringe comprises a 60 cc Vac-Lok syringe or a 30 cc Vac-Lok syringe.

The capturing basket (120) may be configured to be delivered by a delivery catheter (180) from an upstream direction in the blood vessel. In some embodiments, a distal opening of the delivery catheter has one or more extrusions extending from an inner surface of the delivery catheter, and one or more extrusions have sharp edges. The capturing basket (120) may be configured to be delivered by a delivery catheter (180) from an upstream direction in the blood vessel prior to being retrieved by the delivery catheter (180) where the distal opening of the delivery catheter (180) is configured to increase in size to retrieve the capturing basket (120).

In some embodiments, the distal opening of the delivery catheter (180) may have one or more extrusions extending from an inner surface of the delivery catheter (180) where the one or more extrusions have sharp edges and the one or more extrusions are retractable and the one or more extrusions with sharp edges are configured to shear the clot as the capturing basket (120) is retrieved by the distal end of the delivery catheter (180). The delivery catheter (180) may have one or more slits at the distal opening of the delivery catheter (180), where the distal opening of the delivery catheter (180) is configured to increase in size to retrieve the capturing basket.

The clot retrieval device (100) may further include a balloon catheter located near the distal opening of the delivery catheter (180) that has a funnel shape when inflated. The balloon catheter may have pores that, when the balloon catheter is inflated, allow blood to flow through the balloon catheter and prevent large blood clots from flowing through the balloon catheter. The proximal end of the delivery catheter (180) may be configured to be aspirated to aid in the retrieval of the capturing basket into the distal end of the delivery catheter.

The catheter may include a balloon that, when inflated, increases the opening of the distal end of the catheter. The balloon may have a funnel shape, which facilitates retrieval of the capturing basket into the catheter after the capturing basket traps an embolus. The balloon may further include a grid structure where the open areas of the balloon allow blood to pass through the balloon when the balloon is inflated. In various embodiments, the balloon is not limited to a funnel shape. The balloon may be in various shapes, such as a disc or a cylinder. External aspiration may be used on the apparatus to aid in retrieving an embolus.

In one embodiment, aspiration of the proximal end of the catheter may be used to increase the efficiency of embolus removal. The aspiration may be performed while the embolus is trapped within the capturing basket and being pulled into the catheter. In various embodiments, aspiration is not used to retrieve emboli.

In some embodiments, the present invention features a method of removing a clot. The method comprises loading the clot retrieval device (100) into a delivery sheath (170). The delivery sheath (170) is then pushed inside a pre-delivered catheter (180; e.g., an aspiration catheter). Once the clot retrieval device (100) reaches the target lesion, the delivery sheath (170) is withdrawn (i.e., withdrawn from the body). The clot retrieval device (100), more specifically, the capturing basket (120), may help to break the clot from the vessel wall, if necessary. For example, the capturing basket (120) may be rotated (at low rpm such as 2-10 rpm) to dislodge the clot from the vessel wall. The capturing basket (120) may then be used to capture the clot and bring the clot near the tip of the catheter (180; e.g., the aspiration catheter). In some embodiments, aspiration, and retrieval of the clot via the capturing basket (120) work together to remove the clot from the lesion and outside of the body.

The present invention may feature a method of capturing a clot. The method comprises deploying a clot retrieval device (100) as described herein and expanding the capturing basket (120) on a side of the clot, between a vessel wall and the clot. In some embodiments, expanding the capturing basket (120) of the clot retrieval device (100) allows for the clot to ingress laterally into the capturing basket (120) of the clot retrieval device (100), thus capturing the clot. In some embodiments, the clot comprises an embolus.

The present invention may also feature a method of retaining a clot. The method comprises capturing the clot in a clot retrieval device (100) as described herein and visualizing and monitoring a distance between the body markers (125) on a portion of the capturing basket (120). In some embodiments, when the distance of the body markers (125) on the portion of the capturing basket (120) are stationary, the clot is retained in the capturing basket (120), and when the distance of the body markers (125), the portion of the capturing basket (120) changes the clot is escaping. In some embodiments, the clot comprises an embolus.

The present invention may further feature a method of capturing and retaining a clot. The method comprises deploying a clot retrieval device (100) as described herein on a side of the clot. In some embodiments, the method comprises expanding the capturing basket (120) on a side of the clot, between a vessel wall and the clot. In some embodiments, expanding the capturing basket (120) of the clot retrieval device (100) allows for the clot to ingress laterally into the capturing basket (120) of the clot retrieval device (100), thus capturing the clot. The method may further comprise visualizing and monitoring a distance between the body markers (125) on a portion of the capturing basket (120). In some embodiments, when the distance of the body markers (125) on the portion of the capturing basket (120) are stationary, the clot is retained in the capturing basket (120), and when the distance of the body markers (125), the portion of the capturing basket (120) changes the clot is escaping. In some embodiments, the clot comprises an embolus. In some embodiments, the distance of the body markers (125) on the portion of the capturing basket (120) increases. In other embodiments, the distance of the body markers (125) on the portion of the capturing basket (120) decreases.

In some embodiments, the distance of the body markers (125) on a singular portion (e.g., a distal portion or a proximal portion) of the capturing basket (120) increases. For example, if the clot is moving from the outside of the capturing basket (120) into the capturing basket (120) then the distance between the body markers (125) may increase. In some embodiments, the distance of the body markers (125) on a singular portion (e.g., a distal portion or a proximal portion) of the capturing basket (120) decreases. For example, if the clot is moving inside the capturing basket (120) to the outside of the capturing basket (120) then the distance between the body markers (125) may decrease.

In some embodiments, the distance of the body marker (125) within each of the two portions (e.g., a distal portion or a proximal portion) of the capturing basket (120) both increase. In some embodiments, the distance of the body marker (125) within each of the two portions (e.g., a distal portion or a proximal portion) of the capturing basket (120) both decrease. In certain embodiments, the distance of the body markers (125) within each of the two portions (e.g., a distal portion or a proximal portion) change independently from one another.

The present invention may feature a method of indirectly visualizing a captured clot. The method comprises capturing the clot with a capturing basket (120) as described herein and monitoring a distance between the body markers (125) on a portion of the capturing basket (120). In some embodiments, when the distance of the body markers (125) on the portion of the capturing basket (120) is stationary, the clot is captured and retained in the capturing basket (120), and when the distance of the body markers (125) the portion of the capturing basket (120) changes the clot lost from the capturing basket (120).

In some embodiments, while the above-mentioned invention (e.g., the devices described herein) is intended for treating pulmonary embolism, the devices described herein, in their entirety or partiality, are applicable to treating other peripheral vascular diseases including, but not limited to, deep vein thrombosis (DVT) or peripheral arterial clots.

EXAMPLE

The following is a non-limiting example of the present invention. It is to be understood that said example is not intended to limit the present invention in any way. Equivalents or substitutes are within the scope of the present invention.

A common medical condition is a pulmonary embolism, where an embolus gets trapped in the pulmonary artery. Most emboli form within veins deep in the body, such as in the legs. The formed embolus may travel from the legs through the inferior vena cava to the right atrium and right ventricle of the heart. The embolus may travel from the right ventricle to the pulmonary artery. The pulmonary artery bifurcates into a right pulmonary artery and a left pulmonary artery. The right pulmonary artery and left pulmonary artery continually bifurcate further into the lungs to oxygenate the blood. As the right pulmonary artery and left pulmonary artery branch, they become continually smaller, such that the embolus traveling through them may become stuck or lodged and inhibit or reduce blood flow downstream from the embolus. The devices (100) described herein are pushed through the pulmonary artery and delivered to the site of the embolus. The clot retrieval device (100) may trap the embolus so the embolus can be retrieved from the body.

Example 1: Use of a Clot Retrieval Device to Trap and Remove an Embolus from a Body A surgeon uses a guidewire to guide a catheter (180; e.g., an aspiration catheter) towards an embolus through the vasculature of a patient. The surgeon then loads a delivery sheath (170) comprising a clot retrieval device (100) into the pre-delivered catheter (180; e.g., an aspiration catheter) and pushes the delivery sheath (170) through said catheter (180). Once the delivery sheath (170) comprising a clot retrieval device (100) reaches the target lesion (e.g., the embolus), the surgeon is then able to push the clot retrieval device (100) from the distal end of the delivery sheath (170) using the delivery shaft (110). Once the clot retrieval device (100) is outside of the delivery sheath (170), the surgeon then withdraws the delivery sheath (170) from the body through the catheter (180). The capturing basket (120) expands once outside of the delivery sheath (170), allowing for the embolus to ingress laterally into the capturing basket (120) of the clot retrieval device (100), thus capturing the embolus. To ensure the embolus is fully dislodged from the vessel wall, the surgeon rotates the distal end of the delivery shaft (110) to rotate the capturing basket (120). Once the embolus is captured within the capturing basket (120), the surgeon uses the delivery shaft (110) to pull the capturing basket (120) towards the catheter (180). Using the body markers (125) disposed on the capturing basket (120), the surgeon monitors any changes in the distance of said marker. As the surgeon is pulling the delivery shaft (110), the distance between the body markers (125) on the capturing basket (120) begins to increase. To prevent loss of the embolus from the capturing basket (120), the surgeon slows down the pulling of the capturing basket (120) via the delivery shaft (110). Once the distance of the body markers (125) on the capturing basket (120) is stationary, the surgeon knows the clot is captured and retained in the capturing basket (120) and thus pulls the delivery shaft (110) at the newly adjusted rate. Once the capturing basket (120) reaches the distal end of the catheter (180), the surgeon uses aspiration to help pull the embolus and/or the capturing basket (120) into the catheter (180). Once the capturing basket (120) and the embolus are within the catheter (180), the surgeon then removes the catheter from the body.

EMBODIMENTS

The following embodiments are intended to be illustrative only and not to be limiting in any way.

Embodiments Set A

Embodiment 1A: A capturing basket (120) for capturing an embolus, the capturing basket comprising: (a) a first basket end (121) and a second basket end (122), (b) a plurality of cells (123) defined by struts (124), the struts having strut ends that are connected to the first basket end (121) and the second basket end (122), and (c) at least four body markers (125) disposed on the capturing basket (120).

Embodiment 2A: The basket of embodiment 1A, wherein the diameter of the capturing basket (120) is 10 mm to 14 mm.

Embodiment 3A: The basket of embodiment 1A or embodiment 2A, wherein the diameter of the capturing basket (120) is tapered between the first basket end (121) and the second basket end (122).

Embodiment 4A: The basket of embodiment 3A, wherein the first basket end (121) comprises a larger diameter compared to the second basket end (122).

Embodiment 5A: The basket of any one of embodiments 1A-4A, wherein the cells (123) are closed cells.

Embodiment 6A: The basket of any one of embodiments 1A-5A, wherein the cells (123) are quadrilateral in shape.

Embodiment 7A: The basket of any one of embodiments 1A-6A, wherein the cells (123) are rhombus in shape.

Embodiment 8A: The basket of any one of embodiments 1A-7A, wherein the struts (124) comprise surface heterogeneity.

Embodiment 9A: The basket of any one of embodiments 1A-8A, wherein the surface heterogeneity is on an inner surface of the struts (124).

Embodiment 10A: The basket of any one of embodiments 1A-8A, wherein the surface heterogeneity is on a lateral surface of the struts (124).

Embodiment 11A: The basket of embodiment 9A or embodiment 10A, wherein the surface heterogeneity comprises grooves, protrusions, or a combination thereof.

Embodiment 12A: The basket of any one of embodiments 1A-11A, wherein the plurality of cells (123) defined by struts (124) exert an outward radial force.

Embodiment 13A: The basket of any one of embodiments 1A-12A, wherein the plurality of cells (123) defined by struts (124) allows the embolus to ingress into the capturing basket (120).

Embodiment 14A: The basket of any one of embodiments 1A-13A, wherein the capturing basket (120) comprises at least six body markers (125).

Embodiment 15A: The basket of any one of 1A-14A, wherein the capturing basket (120) comprises at least eight body markers (125).

Embodiment 16A: The basket of embodiment any one of embodiments 1A-15A, wherein the body markers (125) are distributed equally between two portions of the capturing basket (120) created by a transverse plane.

Embodiment 17A: The basket of embodiment 16A, wherein the two portions of the capturing basket (120) comprise a distal portion and a proximal portion.

Embodiment 18A: The basket of embodiment 17A, where the body markers (125) are evenly distributed around the distal portion and/or the proximal portion of the capturing basket (120).

Embodiment 19A: The basket of embodiment 18A, wherein the body markers (125) in the distal portion and/or the proximal portion of the capturing basket (120) are 120° apart from each other.

Embodiment 20A: The basket of any one of embodiments 1A-19A, wherein the body markers (125) are disposed on the struts (124) of the capturing basket (120).

Embodiment 21A: The basket of embodiment 20A, wherein the body markers (125) are aligned with the struts (124) of the capturing basket (120).

Embodiment 22A: The basket of embodiment 20A, wherein the body markers (125) are protruded from the struts (124) of the capturing basket (120).

Embodiment 23A: The basket of any one of embodiments 1A-22A, wherein the body markers (125) are radiopaque markers.

Embodiment 24A: The basket of any one of embodiments 1A-23A, wherein the capturing basket (120) is configured to rotate.

Embodiment 25A: The basket of any one of embodiments 1A-24A, wherein the capturing basket (120) rotates at low revolutions per minute (rpm).

Embodiment 26A: The basket of any one of embodiments 1A-25A, wherein the capturing basket (120) rotates at 2 to 10 rpm.

Embodiment 27A: The basket of any one of embodiments 1A-26A, wherein rotating the capturing basket (120) enables controlled shearing of the embolus.

Embodiment 28A: The basket of any one of embodiments 1A-27A, wherein rotating the capturing basket (120) dislodges the embolus from a vessel wall.

Embodiment 29A: The basket of any one of embodiments 1A-28A, wherein the capturing basket (120) is configured to retrieve embolus from two vessels at the same time.

Embodiments Set B

Embodiment 1 B: A clot retrieval device (100) comprising: (a) a delivery shaft (110) having a distal delivery shaft end (111); (b) a capturing basket (120) coupled to the distal delivery shaft end (111), wherein the capturing basket (120) comprises a first basket end (121), a second basket end (122), a plurality of cells (123) defined by struts (124), the struts (124) having strut ends that are connected to the first basket end (121) and the second basket end (122), and at least four body markers (125) disposed on the capturing basket (120); and (c) a support component (150) coupled to the distal delivery shaft end (111) and disposed within the capturing basket (120).

Embodiment 2B: The device (100) of embodiment 1B, wherein the support component (150) comprises: (a) a first support portion (130) comprising a first end (131), a second end (132), and a first lumen (133), wherein the first end (131) of the first support portion (130) is disposed within the basket (120) proximal to the first basket end (121), and (b) a second support portion (140), comprising a first end (141), a second end (142), and a second lumen (143), wherein the second end (142) of the second support portion (140) is disposed within the basket (120) proximal to the second basket end (122).

Embodiment 3B: The device (100) of embodiment 2B, wherein the first support portion (130) is stationary relative to the distal delivery shaft end (111).

Embodiment 4B: The device (100) of embodiment 2B, wherein the support component (150) further comprises an inner shaft (160) disposed through the first lumen (133) of the first support portion (130) and the second lumen (143) of the second support portion (140).

Embodiment 5B: The device (100) of any one of embodiments 2B-4B, wherein the inner shaft (160) is affixed to the second end (142) of the second support portion (140).

Embodiment 6B: The device (100) of any one of embodiments 2B-5B, wherein the inner shaft (160) slides within the first lumen (133) of the first support portion (130).

Embodiment 7B: The device (100) of embodiment 6B, wherein when the inner shaft (160) slides distally within the first lumen (133) of the first support portion (130), away from the first end (131) of the support portion (130), the capturing basket (120) elongates.

Embodiment 8B: The device (100) of embodiment 6B, wherein when the inner shaft (160) slides proximally within the first lumen (133) of the first support portion (130), towards the first end (131) of the support portion (130), the capturing basket (120) collapses.

Embodiment 9B: The device (100) of embodiment 1B, wherein the support component (150) comprises a telescoping shaft.

Embodiment 10B: The device (100) of embodiment 9B, wherein when the telescoping shaft of the support component (150) is extended, the capturing basket (120) elongates.

Embodiment 11 B: The device (100) of embodiment 9B, wherein when the telescoping shaft of the support component (150) is shortened, the capturing basket (120) collapses.

Embodiment 12B: The device (100) of any one of embodiments 1B-11B, wherein the support component (150) comprises flexibility.

Embodiment 13B: The device (100) of any one of embodiments 1B-12B, wherein the diameter of the capturing basket (120) is 10 mm to 14 mm.

Embodiment 14B: The device (100) of any one of embodiments 1B-13B, wherein the diameter of the capturing basket (120) is tapered between the first basket end (121) and the second basket end (122).

Embodiment 15B: The device of embodiment 14B, wherein the first basket end (121) comprises a larger diameter compared to the second basket end (122).

Embodiment 16B: The device (100) of any one of embodiments 1B-15B, wherein the cells (123) are closed cells.

Embodiment 17B: The device (100) of any one of embodiments 1B-16B, wherein the cells (123) are quadrilateral in shape.

Embodiment 18B: The device (100) of any one of embodiments 1B-17B, wherein the cells (123) are rhombus in shape.

Embodiment 19B: The device (100) of any one of embodiments 1B-18B, wherein the struts (124) comprise surface heterogeneity.

Embodiment 20B: The device (100) of any one of embodiments 1B-19B, wherein the surface heterogeneity is on an inner surface of the struts (124).

Embodiment 21B: The device (100) of any one of embodiments 1B-19B, wherein the surface heterogeneity is on a lateral surface of the struts (124).

Embodiment 22B: The device (100) of embodiment 20B or embodiment 21 B, wherein the surface heterogeneity comprises grooves, protrusions, or a combination thereof.

Embodiment 23B: The device (100) of any one of embodiments 1 B-22B, wherein the plurality of cells (123) defined by struts (124) exert an outward radial force.

Embodiment 24B: The device (100) of any one of embodiments 1 B-23B, wherein the plurality of cells (123) defined by struts (124) allow the embolus to ingress into the capturing basket (120).

Embodiment 25B: The device (100) of any one of embodiments 1 B-24B, wherein the capturing basket (120) comprises at least six body markers (125).

Embodiment 26B: The device (100) of any one of embodiments 1 B-25B, wherein the capturing basket (120) comprises at least eight body markers (125).

Embodiment 27B: The device (100) of any one of embodiments 1 B-26B, wherein the body markers (125) are distributed equally between two portions of the capturing basket (120) created by a transverse plane.

Embodiment 28B: The device (100) of embodiment 27B, wherein the two portions of the capturing basket (120) comprise a distal portion and a proximal portion.

Embodiment 29B: The device (100) of embodiment 28B, where the body markers (125) are evenly distributed around the distal portion and/or the proximal portion of the capturing basket (120).

Embodiment 30B: The device (100) of embodiment 28B or embodiment 29B, wherein the body markers (125) in the distal portion and/or the proximal portion of the capturing basket (120) are 120° apart from each other.

Embodiment 31B: The device (100) of any one of embodiments 1B-30B, wherein the body markers (125) are disposed on the struts (124) of the capturing basket (120).

Embodiment 32B: The device (100) of embodiment 31B, wherein the body markers (125) are aligned with the struts (124) of the capturing basket (120).

Embodiment 33B: The device (100) of embodiment 31B, wherein the body markers (125) are protruded from the struts (124) of the capturing basket (120).

Embodiment 34B: The device (100) of any one of embodiments 1B-33B, wherein the body markers (125) are radiopaque markers.

Embodiment 35B: The device (100) of any one of embodiments 1 B-34B, wherein the capturing basket (120) is deployable on a side of a clot in a blood vessel.

Embodiment 36B: The device (100) of any one of embodiments 1 B-35B, wherein the capturing basket (120) is configured to rotate.

Embodiment 37B: The device (100) of any one of embodiments 1 B-36B, wherein the capturing basket (120) rotates at low revolutions per minute (rpm).

Embodiment 38B: The device (100) of any one of embodiments 1 B-37B, wherein the capturing basket (120) rotates at 2 to 10 rpm.

Embodiment 39B: The device (100) of any one of embodiments 1B-38B, wherein rotating the capturing basket (120) enables controlled shearing of the embolus.

Embodiment 40B: The device (100) of any one of embodiments 1B-39B, wherein rotating the capturing basket (120) dislodges the embolus from a vessel wall.

Embodiment 41 B: The device (100) of any one of embodiments 1 B-40B, wherein the capturing basket (120) is configured to retrieve embolus from two vessels at the same time.

Embodiment 42B: The device of any one of embodiments 1 B-41 B, wherein the delivery shaft (110) is braided.

Embodiment 43B: The device of any one of embodiments 1 B-42B, wherein the delivery shaft (110) is hollow.

Embodiment 44B: The device of any one of embodiments 1 B-43B, wherein the delivery shaft (110) is able to withstand torque.

Embodiment 45B: The device (100) of embodiment 44B, wherein the delivery shaft (110) is configured to rotate.

Embodiment 46B: The device (100) of embodiment 45B, wherein the delivery shaft (110) is hand rotated.

Embodiment 47B: The device (100) of embodiment 45B or embodiment 46B, wherein the delivery shaft (110) rotates at low revolutions per minute (rpm).

Embodiment 48B: The device (100) of embodiment 47B, wherein the delivery shaft (110) rotates at 2 to 10 rpm.

Embodiment 49B: The device (100) of any one of embodiments 44B-48B, wherein when the delivery shaft (110) is rotated torque is transferred from the delivery shaft (110) to the capturing basket (120), such that the capturing basket (120) is also rotated.

Embodiment 50B: The device of any one of embodiments 1 B-49B further comprising a first end marker (126) and a second end marker (127).

Embodiment 51B: The device (100) of embodiment 50B, wherein the first end marker (126) is disposed at the first basket end (121) and the second end marker (127) is disposed at the second basket end (122).

Embodiment 52B: The device of embodiments 50B or embodiment 51B, wherein the first end marker (126) and the second end maker (127) are radiopaque markers.

Embodiment 53B: The device (100) of any one of embodiments 1B-52B, further comprising a delivery sheath (170).

Embodiment 54B: The device (100) of any one of embodiments 1B-53B, further comprising a delivery catheter (180).

Embodiment 55B: The device (100) of any one of embodiments 1 B-54B, wherein the device is rotatable.

Embodiment 56B: The device (100) of embodiment 55B, wherein the device is rotated at 2-10 rpm.

Embodiment 57B: The device (100) of embodiment 55B or embodiment 56B, wherein rotating the device allows for controlled shearing of the clot.

Embodiment 58B: The device (100) of embodiment 55B or embodiment 56B, wherein rotating the device allows for the capturing basket (120) to dislodge the embolus from the vessel wall.

Embodiment 59B: The device (100) of any of embodiments 1 B-58B, wherein the capturing basket (120) is configured to be retrieved by a distal opening of a catheter after the clot ingresses into the capturing basket (120).

Embodiments Set C

Embodiment 10: A method of capturing a clot, the method comprising: (a) deploying a clot retrieval device (100) according to Embodiment Set B; and (b) expanding the capturing basket (120) on a side of the clot, between a vessel wall and the clot; wherein expanding the capturing basket (120) of the clot retrieval device (100) allows for the clot to ingress laterally into the capturing basket (120) of the clot retrieval device (100), thus capturing the clot.

Embodiment 2C: A method of retaining a clot in a clot retrieval device (100) as the clot retrieval device (100) is being pulled towards a catheter, the method comprising: (a) capturing the clot in a clot retrieval device (100) according to Embodiment Set B; and (b) visualizing and monitoring a distance between the body markers (125) on a portion of the capturing basket (120), wherein when the distance of the body markers (125) on the portion of the capturing basket (120) are stationary, the clot is retained in the capturing basket (120), and when the distance of the body markers (125), the portion of the capturing basket (120) changes the clot is escaping.

Embodiment 3C: A method of capturing and retaining a clot, the method comprising: (a) deploying a clot retrieval device (100) according to Embodiment Set B on a side of the clot; (b) expanding the capturing basket (120) on a side of the clot, between a vessel wall and the clot; wherein expanding the capturing basket (120) of the clot retrieval device (100) allows for the clot to ingress laterally into the capturing basket (120) of the clot retrieval device (100), thus capturing the clot; and (c) visualizing and monitoring a distance between the body markers (125) on a portion of the capturing basket (120) wherein when the distance of the body markers (125) on the portion of the capturing basket (120) is stationary, the clot is retained in the capturing basket (120), and when the distance of the body markers (125), the portion of the capturing basket (120) changes the clot is escaping.

Embodiment 4C: The method of embodiment 2C or embodiment 3C, wherein the distance of the body markers (125) on the portion of the capturing basket (120) increases.

Embodiment 5C: The method of embodiment 2C or embodiment 3C, wherein the distance of the body markers (125) on the portion of the capturing basket (120) decreases.

Embodiment 6C: The method of any one of embodiments 1C-5C, wherein the clot comprises an embolus.

Embodiment 7C: A method of indirectly visualizing a captured clot, comprising capturing the embolism with a capturing basket (120) according to Embodiment Set A and monitoring a distance between the body markers (125) on a portion of the capturing basket (120); wherein when the distance of the body markers (125) on the portion of the capturing basket (120) are stationary, the clot is captured and retained in the capturing basket (120), and when the distance of the body markers (125) the portion of the capturing basket (120) changes the clot lost from the capturing basket (120).

Embodiment 8C: The method of embodiment 7C, wherein the distance of the body markers (125) on the portion of the capturing basket (120) increases.

Embodiment 9C: The method of embodiment 7C, wherein the distance of the body markers (125) on the lateral side of the capturing basket (120) decreases.

Embodiment 10C: The method of any one of embodiments 7C-9C, wherein the clot comprises an embolus.

Embodiments Set D

Embodiment 1 D: A clot retrieval device (100) comprising: (a) a delivery shaft (110) having a distal delivery shaft end (111); and a capturing basket (120) coupled to the distal delivery shaft end (111), wherein the capturing basket (120) comprises a first basket end (121), a second basket end (122), a plurality of cells (123) defined by struts (124), the struts (124) having strut ends that are connected to the first basket end (121) and the second basket end (122), and at least four body markers (125) disposed on the capturing basket (120).

Embodiment 2D: The device (100) of embodiment 1D, wherein the device (100) is configured such that torque is transferred through the delivery shaft (110) to the capturing basket (120).

Embodiment 3D: A torquable clot retrieval device (100) comprising: (a) a delivery shaft (110) having a distal delivery shaft end (111); and a capturing basket (120) coupled to the distal delivery shaft end (111), wherein the capturing basket (120) comprises a first basket end (121), a second basket end (122), a plurality of cells (123) defined by struts (124), the struts (124) having strut ends that are connected to the first basket end (121) and the second basket end (122), and at least four body markers (125) disposed on the capturing basket (120); wherein the device (100) is configured such that torque is transferred through the delivery shaft (110) to the capturing basket (120).

Embodiment 4D: The device (100) of any one of embodiments 1 D-3D, wherein the delivery shaft (110) is hollow.

Embodiment 5D: The device (100) of any one of embodiments 1D-4D, wherein the device is configured such that a guidewire can pass through the delivery shaft (110) through the second basket end (122); wherein the guidewire is disposed within the capturing basket (120).

Embodiment 6D: The device (100) of any one of embodiments 1 D-5D, wherein the cells (123) at the second basket end (122) of the capturing basket (120) are smaller in size than the cells (123) in the middle of the capturing basket (120) and at the first end (121) of the capturing basket (120).

Embodiment 7D: The device (100) of any one of embodiments 1 D-6D, wherein the body markers (125) are disposed on the struts (124) of the capturing basket (120).

Embodiment 8D: The device (100) of embodiment 7D, wherein the body markers (125) are aligned with the struts (124) of the capturing basket (120).

Embodiment 9D: The device (100) of embodiment 7D, wherein the body markers (125) are in parallel with the struts (124) of the capturing basket (120).

Embodiment 10D: The device (100) of embodiment 9D, wherein the body markers (125) are protruded from the struts (124) of the capturing basket (120).

Embodiment 11D: The device (100) of embodiment 9D or embodiment 10D, wherein the body markers (125) are attached to the struts at a single attachment point.

Embodiment 12D: The device (100) of embodiment 9D or embodiment 10D, wherein the body markers (125) are attached to the struts at two attachment points.

Embodiment 13D: The device (100) of any one of embodiments 1D-12D, wherein the delivery shaft (110) is able to withstand torque.

Embodiment 14D: The device (100) of embodiment 13D, wherein the delivery shaft (110) is configured to rotate.

Embodiment 15D: The device (100) of embodiment 14D, wherein the delivery shaft (110) rotates at 2 to 50 rpm.

Embodiment 16D: The device (100) of embodiment 14D, wherein the delivery shaft (110) rotates at 2 to 10 rpm.

Embodiment 17D: The device of any of embodiments 1D-16D, wherein when the delivery shaft (110) is rotated, torque is transferred from the delivery shaft (110) to the capturing basket (120), such that the capturing basket (120) is also rotated.

As used herein, the term "about" refers to plus or minus 10% of the referenced number.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A clot retrieval device (100) comprising:

a. a delivery shaft (110) having a distal delivery shaft end (111); and b. a capturing basket (120) coupled to the distal delivery shaft end (111), wherein the capturing basket (120) comprises a first basket end (121), a second basket end (122), a plurality of cells (123) defined by struts (124), the struts (124) having strut ends that are connected to the first basket end (121) and the second basket end (122), and at least two body markers (125) disposed on the capturing basket (120); wherein one of the at least two body markers (125) are disposed on a distal portion of the capturing basket (120) and one of the at least two body markers (125) are disposed on a proximal portion of the capturing basket (120);

wherein each body marker (125) is operatively connected to at least one strut (124) via one or more protrusions;

wherein the one or more protrusions disposes each body marker (125) in a separate radial plane from the capturing basket (120), thereby reducing the likelihood that clot material captured by the capturing basket (120) inadvertently escapes the capturing basket (120) during clot retrieval.

2. The device (100) of claim 1, wherein the delivery shaft (110) is hollow.

3. The device (100) of claim 1, wherein the device is configured such that a guidewire can pass through the delivery shaft (110) through the second basket end (122); wherein the guidewire is disposed within the capturing basket (120).

4. The device (100) of claim 1, wherein the cells (123) at the second basket end (122) of the capturing basket (120) are smaller in size than the cells (123) in the middle of the capturing basket (120) and at the first end (121) of the capturing basket (120).

5. The device (100) of claim 1, wherein the delivery shaft (110) is able to withstand torque.

6. The device (100) of claim 5, wherein the delivery shaft (110) is configured to rotate.

7. The device (100) of claim 6, wherein the delivery shaft (110) rotates at 2 to 50 rpm.

8. The device (100) of claim 7, wherein the delivery shaft (110) rotates at 2 to 10 rpm.

9. The device (100) of claim 1, wherein when the delivery shaft (110) is rotated, torque is transferred from the delivery shaft (110) to the capturing basket (120), such that the capturing basket (120) is also rotated.

10. A torquable clot retrieval device (100) comprising:

a. a braid-reinforced, hollow delivery shaft (110) having a distal delivery shaft end (111) and a proximal delivery shaft end; and b. a capturing basket (120) coupled to the distal delivery shaft end (111), wherein the capturing basket (120) comprises a first basket end (121), a second basket end (122), a plurality of cells (123) defined by struts (124), the struts (124) having strut ends that are connected to the first basket end (121) and the second basket end (122), and at least two body markers (125) disposed on the capturing basket (120);

wherein one of the at least two body markers (125) are disposed on a distal portion of the capturing basket (120) and one of the at least two body markers (125) are disposed on a proximal portion of the capturing basket (120);

wherein the device (100) is configured such that torque is transferred through the delivery shaft (110) to the capturing basket (120);

wherein the delivery shaft (110) and the capturing basket (120) are both configured such that torque is transferred from the proximal delivery shaft end to the capturing basket (120) via the delivery shaft (110);

wherein the capturing basket (120) is further characterized by having an unconstrained diameter of about 10 to 18 millimeters and by having an outward radial force of about 0.05 N/mm length to 0.20 N/mm length.

11. The device (100) of claim 10, wherein the device is configured such that a guidewire can pass through the delivery shaft (110) through the second basket end (122); wherein the guidewire is disposed within the capturing basket (120).

12. The device (100) of claim 10, wherein the cells (123) at the second basket end (122) of the capturing basket (120) are smaller in size than the cells (123) in the middle of the capturing basket (120) and at the first end (121) of the capturing basket (120).

13. The device (100) of claim 10, wherein the body markers (125) are disposed on the struts (124) of the capturing basket (120).

14. The device (100) of claim 13, wherein the body markers (125) are aligned or in parallel with the struts (124) of the capturing basket (120).

15. The device (100) of claim 13, wherein the body markers (125) are attached to the struts at a single attachment point, or the body markers (125) are attached to the struts at two attachment points.

* * * * *